US007775148B1

(12) United States Patent
McDermott

(10) Patent No.: US 7,775,148 B1
(45) Date of Patent: Aug. 17, 2010

(54) MULTIVALVE HYPERVELOCITY LAUNCHER (MHL)

(76) Inventor: Patrick P. McDermott, 2411 Rocky Branch Rd., Vienna, VA (US) 22181

( * ) Notice: Subject to any disclaimer, the term of this patent is extended or adjusted under 35 U.S.C. 154(b) by 1257 days.

(21) Appl. No.: 11/327,479

(22) Filed: Jan. 9, 2006

Related U.S. Application Data

(60) Provisional application No. 60/642,125, filed on Jan. 10, 2005.

(51) Int. Cl.
*F41A 1/02* (2006.01)

(52) U.S. Cl. ..... 89/8; 89/1.809; 124/60; 124/73

(58) Field of Classification Search ..... 124/60, 124/56, 59, 70, 71, 73, 75; 89/7, 8, 1.809, 89/1.81
See application file for complete search history.

(56) References Cited

U.S. PATENT DOCUMENTS

| | | | | |
|---|---|---|---|---|
| 1,356,858 | A | 10/1920 | Fitzpatrick | |
| 2,754,607 | A * | 7/1956 | Wily | 42/55 |
| 3,132,562 | A | 5/1964 | Frevel | |
| 3,357,306 | A * | 12/1967 | Boyd et al. | 89/8 |
| 3,379,163 | A * | 4/1968 | Wiethoff | 114/238 |
| 3,459,101 | A * | 8/1969 | Scanlon, Jr. et al. | 89/8 |
| 3,536,054 | A | 10/1970 | Stevens et al. | |
| 4,336,741 | A * | 6/1982 | Baines | 89/7 |
| 4,590,842 | A * | 5/1986 | Goldstein et al. | 89/8 |
| 4,796,510 | A * | 1/1989 | Piesik | 89/1.816 |
| 5,016,518 | A * | 5/1991 | Kaplan et al. | 89/8 |
| 5,183,956 | A * | 2/1993 | Rosenberg | 89/8 |
| 5,303,553 | A | 4/1994 | Olliveau et al. | |
| 5,332,002 | A | 7/1994 | Reimert | |
| 5,381,722 | A | 1/1995 | Begneu | |
| 5,631,436 | A * | 5/1997 | Brown et al. | 89/8 |
| 6,679,155 | B1 | 1/2004 | Yaschur et al. | |

* cited by examiner

*Primary Examiner*—Benjamin P Lee
(74) *Attorney, Agent, or Firm*—James Creighton Wray; Meera P. Narasimhan

(57) ABSTRACT

Launching payloads at high velocity uses high-pressure gas or combustion products for propulsion, with injection of high pressure gas at intervals along the path behind the payload projectile as it accelerates along the barrel of the launcher. An inner barrel has an interior diameter equal to the projectile diameter or sabot containing the projectile. An outer casing surrounds the inner barrel. Structures at intervals attach the outer casing and the inner barrel. An axial gas containment chamber (AGC) stores high pressure gas between the inner barrel wall, the outer casing wall, and enclosure bulkheads. Pressure-activated valves along the barrel sequentially release the high pressure gas contained in the AGC in to the barrel to create a continuously refreshed high energy pressure heads behind the projectile as it moves down the barrel. A frangible cover at the exit end of the barrel allows the barrel to be evacuated prior to launch. The launcher is rapidly recyclable. The valves close automatically after the projectile has exited the barrel, allowing a new projectile to be introduced into the breech and the AGC to be recharged with high-pressure gas.

25 Claims, 16 Drawing Sheets

MULTIVALVE HYPERVELOCITY LAUNCHER (MHL)

This application claims the benefit of U.S. Provisional Application No. 60/642,125 filed Jan. 10, 1005, which is hereby incorporated by reference in its entirety.

BACKGROUND OF THE INVENTION

1. Field of the Invention

This invention relates to a mean for propelling payloads along a barrel utilizing compressed gas or combustion products.

2. Description of Prior Art

Conventional guns hurl projectiles along the gun barrel by means of chemical propellants which, when ignited in the breech, create high-pressure gases which expand behind the projectile, accelerating it along the barrel. This method, used in forms of weaponry, from cannons, to rifles and handguns, has a fundamental limitation. Once the projectile reaches a high velocity, its speed approaches a limit corresponding to the velocity of the shock wave of the expanding gas.

In practice, the pressure in a gun barrel typically spikes early in the discharge of the gun so that the projectile experiences a very high acceleration at the beginning of discharge. However, as the projectile proceeds down the barrel of the gun, the pressure head behind the projectile begins to decrease, and thus decreases the force of acceleration. In order to increase range, base bleed projectiles have been developed. Additional propellant contained in the projectile is ignited after exiting the barrel to increase the velocity.

Many schemes have been invented to compensate for the velocity limitations of the conventional gun. In light gas guns, for example, helium or hydrogen is used as the propelling gas, where the shock wave travels much faster than that associated with the combustion product gases of the conventional gun. Thus, theoretically and practically, a light gas gun can achieve higher exit velocities from the same length of barrel than can conventional chemical propellant guns. Light gas guns, however, are somewhat limited in the weight of projectiles that can be launched. In a one-stage light gas gun, the gas is contained in a high-pressure vessel near the breech of the gun, and is injected behind the projectile upon discharge by bursting a pressure diaphragm between the pressure vessel and the barrel.

In an alternate version of the light gas gun, pressure storage tanks are located along the barrel with the release of gas triggered to correspond with the passage of the projectile.

In a two-stage light gas gun, there are two chambers or barrels, a larger one containing un-pressured helium or hydrogen, separated from another small caliber barrel containing the projectile by a frangible disk. A chemical charge is ignited in the aft end of the larger chamber forces a piston along the barrel compressing the light gas to the point where the frangible disk breaks and subjects the breech end of the projectile containing barrel to extremely high pressure.

In another novel means of propulsion, a supersonic ramjet or scramjet principle is used to propel the projectile down a barrel that contains an explosive mixture of gas (e.g., oxygen and hydrogen or methane). The projectile is first accelerated by ignition of the gas mixture behind the projectile and giving it an initial impulse. As the projectile travels down the barrel, the un-ignited gases flow around the projectile and are ignited by pressure waves at the base of the projectile, and thus continue the acceleration of the projectile down the barrel. The projectile literally flies supersonically down the barrel of the gun. Although this method overcomes, in principal, the limitation of an expanding gas, as described above, is has practical limitations which to date has limited its application beyond that of laboratory curiosity.

Other non-chemical or compressed gas means of propulsion include electrical or electromagnetic launch schemes. In the so-called rail gun, the barrel consists of two or more rails that are capable of supporting very high current electrical discharge. The projectile essentially shorts out the rails when high voltage is applied, creating a conductive plasma behind the projectile, resulting in an accelerating electromagnetic force that drives the projectile down the barrel. This method of launch suffers from a number of technical challenges. It requires a very large electrical pulse network to feed the rails. Furthermore, erosion of the rails during the launch of the projectile limits the life of the system to a small number of "shots" before the rails need refurbishment.

In an alternate approach, strong magnetic coils are activated along the barrel creating an accelerating magnetic force that propels the payload down the barrel. This coil gun approach also suffers from practical problems associated with the large and costly electrical pulse networks required to fire the projectile, large power switching, as well as, inefficiencies in the transfer of energy from magnetic to linear motion.

In a hybrid chemical/electromagnetic gun, a chemical charge is first ignited in the breech of the gun, with electrodes in the breech simultaneously conducting a heavy electrical discharge that further energizes the plasma driving the projectile down the barrel. This system extends the accelerating force by continuing to feed the plasma energetically. It is, however, limited by the same principals that limit the conventional gun, that is, the projectile velocity is limited by velocity of the shock front of the propelling gas or plasma.

Needs exist for improved accelerating of projectiles through the barrels.

SUMMARY OF THE INVENTION

The new multivalve hypervelocity launcher (MHL) utilizes the same basic principal of sequential introduction of high-pressure gas behind the projectile, but with a different design architecture that is more efficient, potentially much lower cost, transportable, and suitable for launching larger projectiles. The MHL system contains attributes of some of the above-mentioned systems, such as the storage of high-pressure light gas, combustion of hydrogen/oxygen to produce the high pressure gas, venting of the gas at intervals along the barrel, and the use of base-bleed projects. But the MHL differs significantly in how the compressed gas/or ignition products are stored and injected into the barrel behind the projectile at the multiple ports. The MHL launcher invention overcomes many of the limitations described above, by injecting high-pressure gas in a continuous manner through many ports behind the projectile all along the path of its travel down the barrel. The projectile experiences a more constant, albeit higher, accelerating force throughout the length of the barrel, because the pressure head behind the projectile is constantly refreshed by the opening of valves sequentially along the barrel, and the release of high pressure gas behind and at the base of the projectile, as the projectile traverses the barrel. This avoids the high-G pressure spikes normally associated with conventional chemical guns, and avoids the phenomenon of the projectile being limited by the velocity limits of the shock wave of the expanding gas.

The MHL system utilizes a soft launch technique that simplifies the construction of the payload and opens up a spectrum of payloads that can be accommodated by the launcher. The payload projectile, its components, and electronics need not be hardened against the high-G pressure spikes. 10,000 g constant force replaces 50,000 g peaks found in chemical guns. This gives flexibility in the use of the materials and structures that can sustain a constant, but lower G level during the launch process.

In the MHL launcher, the stored compressed gas surrounds the barrel so there is a very short path between the axial gas containment chamber, AGC, between the inner and outer barrels, contiguous to the barrel, and the barrel chamber itself. Thus, the distance of travel of the propelling gas to the base of the projectile is short, such that the pressure head, originally developed in the breech of the barrel is constantly replenished as the projectile travels down the barrel. In the case of the explosive mixture approach, the mixture prior to ignition is stored in the annular chamber that runs the entire length of the barrel.

The MHL system relies on the unique design of the fast acting valves along the barrel that is triggered by the pressure head behind the projectile as it travels down the barrel. In the preferred embodiment, the valves are held shut by the extreme pressure differential between the AGC, and the barrel chamber, BC, either evacuated or not evacuated, prior to the launch sequence. The valve is then opened by pressure differences as the projectile passes the valve, as will be discussed in detail in the description of the system.

During the passage of the projectile down the barrel, the pressure head behind the projectile, and the pressure in the AGC, begin to reach equilibrium as the projectile passes each valve. This lessens the extreme pressure differential, as the projectile reaches the valve, triggering the opening of the valve, just as the projectile is passing the valve. The flow of high-pressure gas from the ACG into the BC directly behind the moving projectile, maintains the pressure head in the barrel throughout the passage of the projectile down the barrel.

The MHL uses an obdurator plate, OP, behind the projectile to provide a seal between the projectile and the high pressure gas in the barrel. The OP is a robust disk made from a polymeric material like polyethylene, with an outer diameter fitting snugly with the inner diameter of the metal barrel. During travel down the barrel, the outer rim of the OP may oblate slightly, due to the heat, and provide a very low friction gas bearing between the barrel and the projectile being pushed along by the OP.

The MHL system can be operated as a stored compressed gas system, including light gases, or as a system that utilizes combustion products, generated in the storage area contiguous to the barrel, or in the barrel itself, from precursor fuels and oxidizers stored outside the barrel, or in the projectile itself. Variants of the system can use a variety of oxidizers and fuels within the AGC and the projectiles. The MHL unique features make it practical and economical to build, transport, assemble, operate and maintain.

The MHL design is modular. Identical sections are serially produced in an off-site facility. Subsections are transportable to the launch site for assembly and integration. To maintain the low cost aspects of the system, it utilizes commercially available materials such a large diameter high pressure steel pipe and fittings commonly used for pipelines or other industrial applications where market forces have already established competitive prices. The concept is scalable, meaning, the length and diameter of the barrel, can be sized to meet the requirements of the specific application.

The MHL design also allows for a wide variety of applications both large and small. The following are examples of historic use of hypervelocity guns for both civilian, as well as, defense research, which are examples of applications for MHL. In general, these applications range from very light projectiles (grams) at extremely high velocities (6-8 km/sec), to larger payloads (hundreds of kilograms) at slower, but still significant velocities (2-3 km/sec).

Hypervelocity research for hypervelocity guns have been used in the past for a variety of scientific studies related to the acceleration and interaction of materials at hypervelocity speeds. These studies have launched small sub-kilogram payloads at incredible speeds approaching 10 km/sec.

Lethality studies of hypervelocity guns have been used to launch sub-scale models of hit-to-kill vehicles, used for ballistic missile defense, into different target types, to assess damage and lethality.

Economic launch of instrumented packages into the upper atmosphere is possible with the new MHL. During Project HARP, High Altitude Research Project, 1960-1970, approximately 175 Martlet 2 atmospheric sounding flights were conducted with large caliber 16 inch guns, able to loft to experimental packages to 180 km altitudes. A much larger number of 5-inch and 7-inch flights were also conducted throughout North America for meteorological research purposes.

The new MHL provides economic launch of rocket-assisted payloads into low earth orbit. The HARP project, support by both the US and Canadian governments, also performed numerous studies and experiments related to firing large bore, high mass fraction solid rocket motors (1000 kg) into space. While not actually achieving orbital or space capability, the time and resource-limited HARP activity did establish the feasibility of such a venture.

The new MHL incorporates many features that make the concept more economically viable as an instrument for research as well a means for orbiting space payloads at a fraction of the cost of current methods. Current commercial launches approach $10,000/lb for very large payloads to tens of thousands of dollars/lb for smaller payloads.

The invention encompasses a compressed gas launch system, and variants of that system, for launching payloads, at high velocity, using high-pressure gas or combustion products as a means of propulsion. An object of the invention is to provide a means of injecting high-pressure gas at specified intervals along the path of, and behind, the payload projectile as it accelerates along the barrel of the launcher.

The invention provides a high-pressure axial gas storage chamber, AGC, parallel to and contiguous to the barrel and connected to the barrel through periodic structures or bulkheads, that add structural stability to both the storage chamber and the barrel, and with end enclosures to provide high-pressure containment of the stored gas.

The invention provides an inner barrel chamber (IBC) that can be evacuated by means of a pump, by sealing each end of the barrel with an aft breech door, and, at the muzzle end, a frangible cover to be breeched by the projectile upon exit, or a rapid activation cover that opens just prior to exit of the projectile.

The invention provides a means for injecting high pressure gas from the AGC to the IBC, first at the breech end, and the sequentially, along the barrel, but behind the projectile, through numerous valves along the barrel, in a sequence that accelerates as the projectile accelerates down the barrel.

Another object of the invention is to provide a fast-acting valve (FAV), the opening of which is timed with, or triggered by, the passage of the projectile past the valve, allowing high pressure gas in AGC to exit into the IBC through ports in the barrel, providing a near constant pressure head against the aft end of the projectile as it exits the barrel.

Another object of the invention is to provide a valve design, the closing of which is accomplished by, or aided by, the pressure differential between the high pressure AGC prior to launch, and the evacuated or non-evacuated, but lower pressure IBC.

Yet another object of the invention is that the opening of the FAV is accomplished by, or aided by, the lessening of the pressure differential as the projectile passes the value, wherein, the pressure head behind the projectile and the pressure within the storage chamber become equilibrated.

The invention provides the option of using single port FAVs or integrated multi-port FAVs that increase the total area of the apertures ports between the AGC and the IBC.

It is a further object of the invention that the FAVs are "recyclable" that is the can automatically reset to the closed position after the passage of the projectile, thus allowing for a "second shot" without having to replace high pressure frangible disks or other hardware required to operate high pressure gun systems.

It is a further object of the invention, that means of propulsion may be accomplished other than the storage of energy in compressed inert gas, and that the pressurization of the AGC may be accomplished by the ignition of a combustible mixture of hydrogen or oxygen or other chemical species in the AGC.

It is a further object of the invention that the pressurization of the AGC can be accomplished by creation of the high pressure gas in a separate vessel connected to the AGC which is then injected into the AGC just prior to launch, thus minimizing effects of any leakage points in the multiple FAV ports.

It is a further object of the invention that the ACG could be further divided into chambers, each parallel to the barrel, one containing, in gaseous form, an oxidizing agent, the other a reducing agent, each of which is released into the area behind the projectile, by means previously discussed, in order to maintain combustion at the aft end of the projectile, with combustion products maintaining the pressure head. The concept could support the utilization of bipropellant hypergolic substances, the mixture of which at the aft end of the projectile causes exothermic release of energy to maintain the pressure head.

It is a further object of the invention that an alternate means of propulsion is accomplished when an oxidizing (or reducing) agent, in gaseous form, is contained in the AGC, and the complementary agent (oxidizer or reducing agent) is contained in the projectile itself in the form of a solid, liquid, or compressed gas ejected from the aft end of the projectile, thus creating a combustion front behind the projectile as it travels down the barrel.

It is a further object of the invention that the projectile itself could be a solid or liquid propellant rocket with payload that is given an initial boost by means of the MHL, and then ignites after transiting the MHL, to further propels the payload into a ballistic or orbital trajectory.

It is a further object of the invention that the projectile can embody different shapes, forms, and seals to reduce friction in the barrel, and to enhance the quick activation of the valves, including the use of expendable or reusable sabot structures that encloses the projectile payload and provides a means for traversing the barrel, but is detached from the payload as the object exits the barrel.

It is a further object of the invention to use obdurator plates in various configurations to provide a low-friction means of sealing and transferring forces from the high pressure gas in the barrel to the projectile as it moves along the barrel.

It is a further object of the invention to reduce cost and enhance portability that the MHL is made in segments or sub modules that can be built as separate units in the factory then transported and bolted together at the launch site facility. To reduce cost, many of the components are commercially available. Large steel pipes for the AGC are similar to products in the oil and gas industry.

It is a further object of the invention that the double walled axial barrel with internal supports increases the torsional and hoop strength of the compound barrel so that its weight is minimized. This allows very long barrels to be constructed which when augmented with structural supports, can be mounted on gantries that allow the MHL to be aimed in azimuth and elevation to support space launch missions.

The invention provides a new projectile launcher barrel apparatus. An inner barrel has an inner barrel chamber with proximal and distal ends. A projectile is placed in the inner barrel chamber near the proximal end. An outer casing surrounds the inner barrel. An axial gas chamber surrounds the inner barrel between the inner barrel and the outer casing. Plural spaced pressure-activated valves connect the axial gas chamber and the inner barrel chamber. The valves sequentially and automatically open from pressure behind the projectile, admitting pressurized gas from the axial gas chamber to the inner barrel chamber and accelerating the projectile through the inner barrel toward the distal end.

Bulkheads extend radially outward from the proximal and distal ends of the inner barrel to the outer casing. Diagonal stiffening connectors are welded between the inner barrel and the outer casing stiffening the inner barrel. Internal bulkheads radially extend between the inner barrel and the outer casing at spaced intervals between the bulkheads at the proximal and distal ends. The internal bulkheads have openings permitting pressure front travel along the axial gas chamber from near the bulkhead at the proximal end toward the bulkhead at the distal end.

The automatic pressured operated valves are positioned on sides of the internal bulkheads away from the proximal end and admit pressurized gas to the inner barrel chamber behind the projectile as the projectile passes the valves. A pump is connected to the axial gas chamber, and a source of pressurized gas is connected to the pump for supplying the axial gas chamber with gas at increased pressure. In one embodiment, a pressurized gas storage chamber and a valve are added between the pump and the axial gas chamber for storing pressurized gas in the storage chamber and supplying pressurized gas from the storage chamber to the axial gas chamber. An igniter is position in the storage chamber for igniting, combusting gas, and increasing pressure in the storage chamber prior to supplying the gas to the axial gas chamber. In another embodiment, an igniter is mounted in the inner barrel chamber for igniting, combusting, increasing pressure and expanding gas in the inner barrel chamber and driving the projectile through the inner barrel chamber toward the distal end. In other embodiments, dividers extend axially through the axial gas chamber between the inner barrel and the outer casing, dividing the axial gas chamber into first and second sides. An oxidant gas inlet is connected to the casing on the first side of the axial gas chamber, and a reactant gas inlet is connected to the casing on the second side of the axial gas chamber for separately flowing oxidant, and reactant gases onto the casing and into the inner barrel chamber for oxidizing, combusting, expanding and pressurizing gas in the inner barrel chamber and driving the projectile toward the distal end. In one embodiment, a source of oxidant gas is connected to the axial gas chamber, and a reactant source is connected to the projectile for oxidizing, combusting, expanding and pressurizing gas in the inner barrel chamber and driving the projectile toward the distal end.

The projectile includes a payload, a rocket motor, and an obdurator on the rocket motor for driving the obdurator with the pressurized gas in the inner barrel chamber and driving the rocket motor and the payload through the inner barrel chamber. The automatic pressured activated sequencing valves have sealing seats and sliders on the seats. The sliders have relatively large lifting areas and relatively small opposite retainer areas. As the projectile passes the valves lower pressures within the inner cylinder chamber produce greater forces on the large areas, and higher pressures within the axial gas chamber produce lesser forces on the small retainer areas. The force differential between the greater forces and the smaller forces move the sliders away from the seats, releasing pressure from the axial gas chamber to the inner barrel chamber behind the projectile.

Closed volumes and compression springs are located opposite the larger areas of the sliders. Extensions and seals near the larger areas of the sliders isolate the closed volumes when the extensions engage the seals and the sliders engage the seals. Moving the sliders to open the valves moves the extensions away from the seals for communicating pressure in the axial gas chamber to the closed volumes when the sliders move away from the seats. Equalizing pressures and forces on opposite sides of the sliders with pressure from within the axial gas chamber allows the springs to close the valves after they have been opened.

In one embodiment, the valves have single ports and are arranged radially on the inner barrel. The seats surround the single ports. The sliders are cup or hat-shaped and have rims engaging the seats. Inner volumes of the sliders have with outer walls and tops for receiving pressures from within the inner barrel chamber. The extensions extend outward from the tops. The closed volumes have walls and outer ends for engaging the springs, and the walls have inward extending lips for holding the seals against the extensions.

In another embodiment, the valves have multiple ports and are arranged annularly around the inner barrel. The sliders are annular and dish-shaped and have axially extending cylindrical walls with first and second ends. Radial rims extend from the first ends of the axially extending cylindrical walls. The rims form the small areas. The sliders have radially extending annular tops at the second ends of the walls. The tops are the large areas for receiving the pressure from within the inner barrel chamber. The extensions are annular extensions extending radially from the second ends of radially extending cylindrical walls. The closed volumes are annular chambers formed with axial walls, and annular tops against which the springs bear. Inward extending annular radial lips opposite the closed volume top hold the seals against the annular extensions until the annular dish-shaped sliders are moved by pressure from the inner barrel chamber when the projectile passes the valves.

Multiple inner barrels and outer casings are joined end-to-end, forming an elongated projectile launcher barrel, having breech and muzzle ends. The elongated projectile launcher barrel is supported in one embodiment by a trunion on a proximal end and plural cables along the elongated projectile launcher barrel. The cables are suspended from an A-frame truss. In another embodiment, multiple inner barrels and outer casings are joined end-to-end, forming an elongated projectile launcher barrel. The elongated projectile launcher barrel is supported by flotation collars near breech and muzzle ends and is erected by flooding a flotation collar near the proximal end and submerging the breech end.

A new method of projectile launching includes providing an inner barrel having breech and muzzle ends, providing an inner barrel chamber in the inner barrel, receiving a projectile in the inner barrel chamber near the breech end of the inner barrel, providing an outer casing surrounding the inner barrel, providing an axial gas chamber between the inner barrel and the outer casing, providing supporting interconnections between the inner barrel, and providing series of valves along the inner barrel.

The launching is started by evacuating the inner barrel chamber on the muzzle end side of the projectile, providing pressurized gas in the axial gas chamber, and providing pressure on the breech end side of the projectile.

Sequentially opening the valves with force differentials of inner barrel chamber lower pressures applied to relatively large areas and axial gas chamber higher pressures applied to smaller areas flows pressurized gas from the axial gas chamber through open valves into the inner barrel chamber behind the projectile as the projectile moves from the breech end to the muzzle end, accelerating the projectile from the breech end through the inner barrel chamber and outward through the muzzle end. In one embodiment, oxidizer gas and reactant gas are flowed separately through the valves, and the oxidizer gas and the reactant gas react in the inner barrel chamber. Another embodiment provides a chemical reactant on the projectile. Flowing pressurized oxidizer gas into the inner barrel chamber is followed by reacting the oxidizer gas and the reactant in the inner barrel chamber behind the accelerating projectile.

The invention provides new gas force opening valves. The new valves open with lower pressures operating against higher resistant pressures. The valves have sealing seats and sliders seated on the seats. The sliders have relatively large areas and relatively small opposite retainer areas. Lesser pressures within the valves produce greater forces on large areas, and greater pressures outside of the valves produces lesser forces on the smaller retainer areas. Differential forces between the greater forces and the smaller forces move the sliders away from the seats, releasing greater pressure from outside of the valves to the inside of the valves.

Closed volumes and compression springs are positioned opposite the large areas of the sliders. Extensions and seals opposite the large areas of the sliders isolate the closed volumes when the extensions engage the seals and the sliders engage the seals. Moving the extensions away from the seals communicates pressure outside of the valves to the closed volumes when the sliders move away from the seats. Equalizing pressures and forces on opposite sides of the sliders with pressure from outside of the valves, and allowing the springs to close the valves after the valves have been opened.

The valves are arranged radially on a cylinder. The seats surround single ports in a cylinder wall. The sliders are cup or hat-shaped and have rims engaging the seats. Inner volumes of the sliders have tops for receiving pressures from within the valves. The extensions extend outward from the slider tops. The closed volumes have walls and outer ends for engaging the springs. The walls have inward extending lips for holding the seals against the extensions while the valve sliders are seated. In another embodiment, the valves have multiple ports and are arranged annularly around a cylinder. The sliders are annular and dish-shaped and have axially extending cylindrical walls. Radial rims extend from first ends of the walls forming the smaller areas, and wherein the sliders have radially extending tops at opposite second ends of the walls as the large areas for receiving the pressure from within the valves. The extensions are annular extensions extending radially from the slider walls. The closed volumes are annular chambers formed with axial walls, annular radial tops against which the springs bear, and inward extending annular radial lips holding the seals against the annular extensions until the annual dish-shaped sliders are moved by pressure from within the valves.

These and further and other objects and features of the invention are apparent in the disclosure, which includes the above and ongoing written specification, with the claims and the drawings.

DETAILED DESCRIPTION OF THE PREFERRED EMBODIMENTS

Figure 1A:
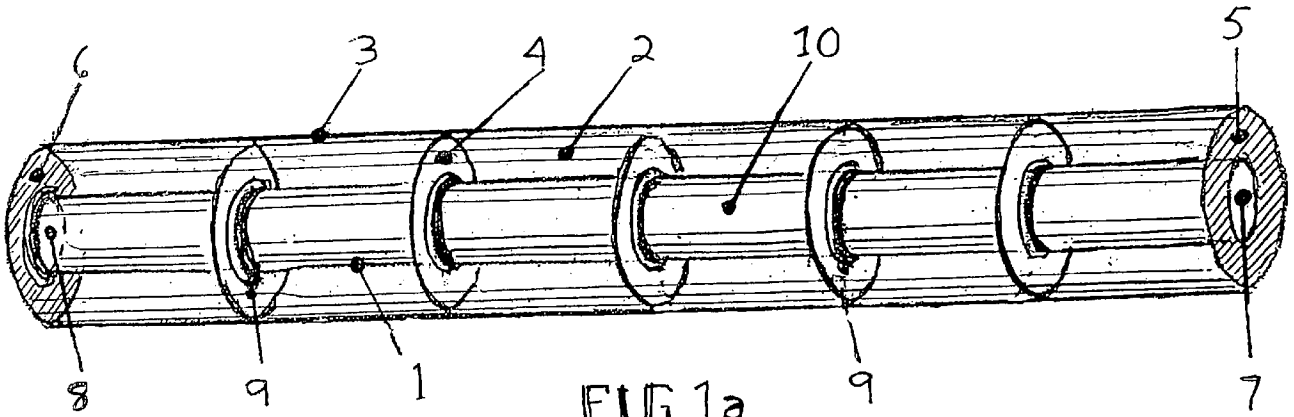
FIG. 1*a* shows the basic structure of the new launcher.

FIG. 1*a* shows this basic structure of the MHL system. This includes the inner barrel 1 which contains the projectile during the launch sequence; the AGC, axial gas chamber 2 formed by the IB, inner barrel 1 and the OC, outer casing 3; with internal bulkheads 4 other structures that align and connect the inner barrel and the outer casing, end closure bulkheads fore 5 and aft 6.

The muzzle end of the barrel can be closed off with a frangible cap 7 or fast acting retractable valve or cover that opens just prior to exit of the projectile and closes after exit of the projectile, to conserve the pressurized Helium or Hydrogen. At the other end is the breech assembly 8 that allows insertion of the projectile, and when closed and sealed, allows the inner barrel chamber IBC to be evacuated. Activation valves 9 shown at each internal bulkhead, when triggered, allow high-pressure gas in the AGC 2 to flow into the IBC 10 behind the projectile. FIG. 1*a* shows a composite of the major elements of the basic structure in a configuration where the length to diameter (L/D) is six to one (6:1). In an actual integrated system, the MGL would have a much higher L/D, made up of 10 to 20 or more of these units bolted together to form the complete system, with L/Ds reaching over 100:1. A 1-2 meter diameter system might reach 100-200 meters in length depending on the application. In general the diameter of the outer casing 3 will be two to three times that of the inner barrel 1, but the exact dimensions will be determined by each applications.

Figure 1B:
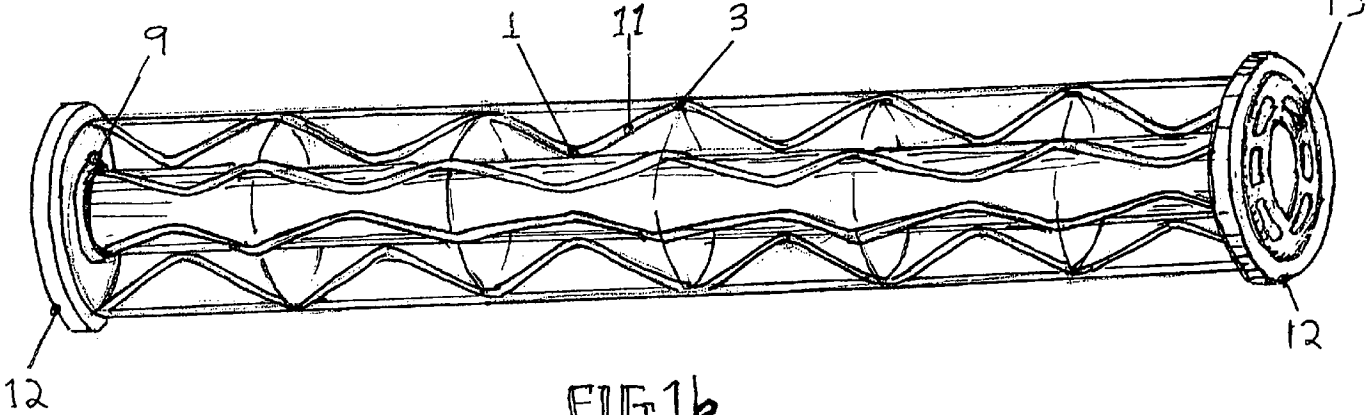
FIG. 1*b* shows an alternate internal support and end flanges for length augmentation.

FIG. 1*b* shows a variant of the basic unit with fore and aft enclosure bulkheads 5 and 6, with one activation valve at the aft end 9. In this configuration, and a number diagonal rods or pipes 11 welded to the inner barrel 1 and the outer casing 3 take the place of the internal structural bulkheads 4 to reduce cost of manufacturing and provide greater structural integrity and stiffness. When the projectile is moving down the barrel, from left to right, very large reaction forces (recoil) would be induced in the inner barrel, from right to left. The diagonal stiffeners might provide a better means of transferring these forces to the outer casing, than the structural bulkheads shown in FIG. 1*a*. FIG. 1*b* also shows flanges 12 fore and aft, which are used to mate one basic unit to another, in order to form the total system.

Thus, in a complete system, multiple units of the basic modules in FIG. 1*b*, when mated together, would contain many FAVs, at regular intervals along the barrel. Openings 13 in the fore and aft bulkheads allow for gas to flow from one module to the next when units are bolted together to form the total system. The total system would then contain multiples of these basic modules, with fore end unit containing the frangible cap/muzzle cover assembly 7, and the aft end unit containing the breech assembly 8.

Principal of Operation

Figure 2A:
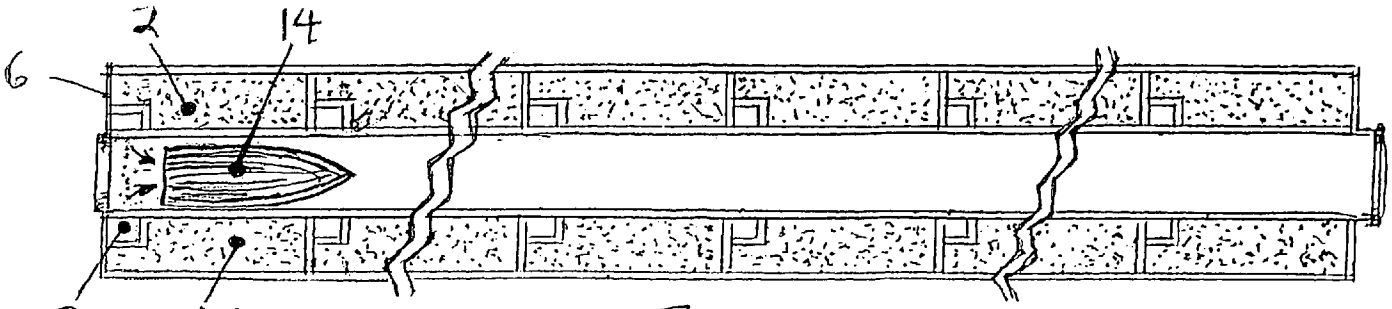
FIGS. 2*a*, b and c show launch sequences.
Figure 2B:
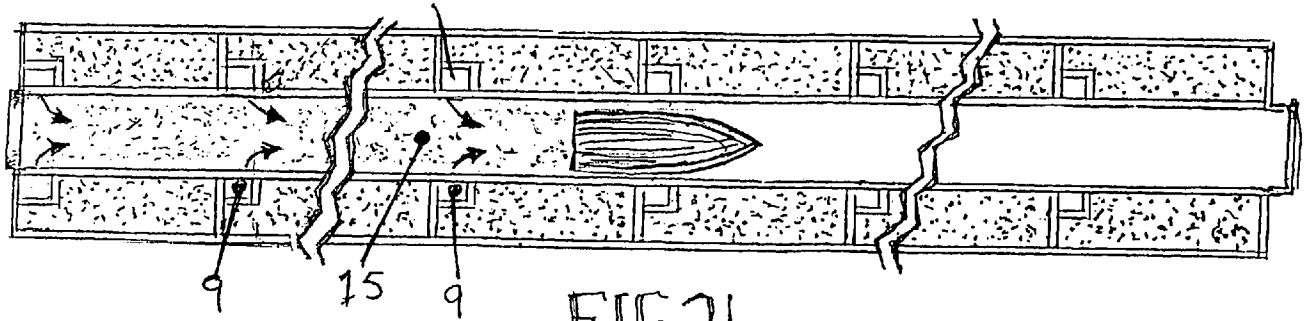
Figure 2C:
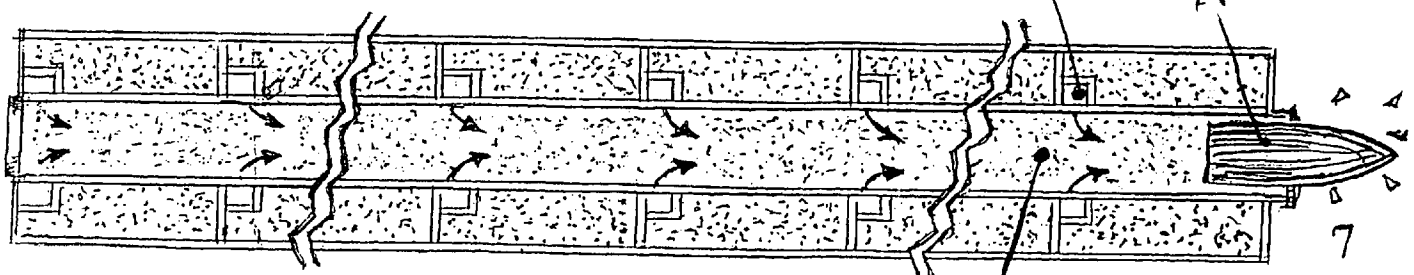

FIGS. 2*a*, 2*b*, and 2*c* shows the launch sequence first at the breech end 6 in FIG. 2*a* where the high pressure gas 15 enters the IBC 10 via valve 9 from the AGC 2 accelerating the projectile 14 along the barrel with high pressure gas 15 flowing into the barrel sequentially through the multiple valves 9 maintaining a high pressure head 15 behind the projectile as shown in FIG. 2*b*. In the final stage of launch shown in FIG. 2*c*, the projectile breaks through the frangible cap 7 at the muzzle of the MHL. The breaks illustrated in the figures are to illustrate that the MHL barrel is much longer than the L/D of 6:1 shown in the figures.

Figure 3A:
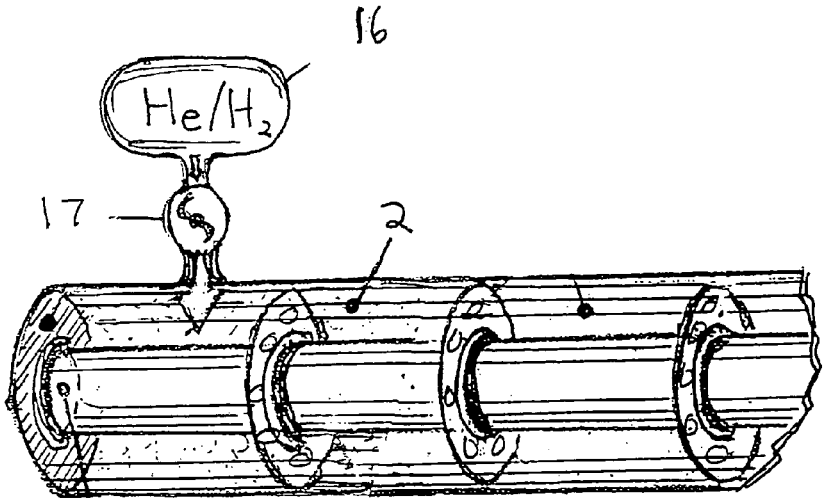
FIG. 3*a-g* show variants of high pressure gas generating, storing, igniting and injecting.

FIGS. 3*a*-3*g* show a variety of mechanisms available to provide the high pressure gases needed for launch. FIG. 3*a* shows the simplest embodiment where a light gas, helium or hydrogen 16 is pumped into the AGC 2 by means of a high-pressure pump 17.

Figure 3B:
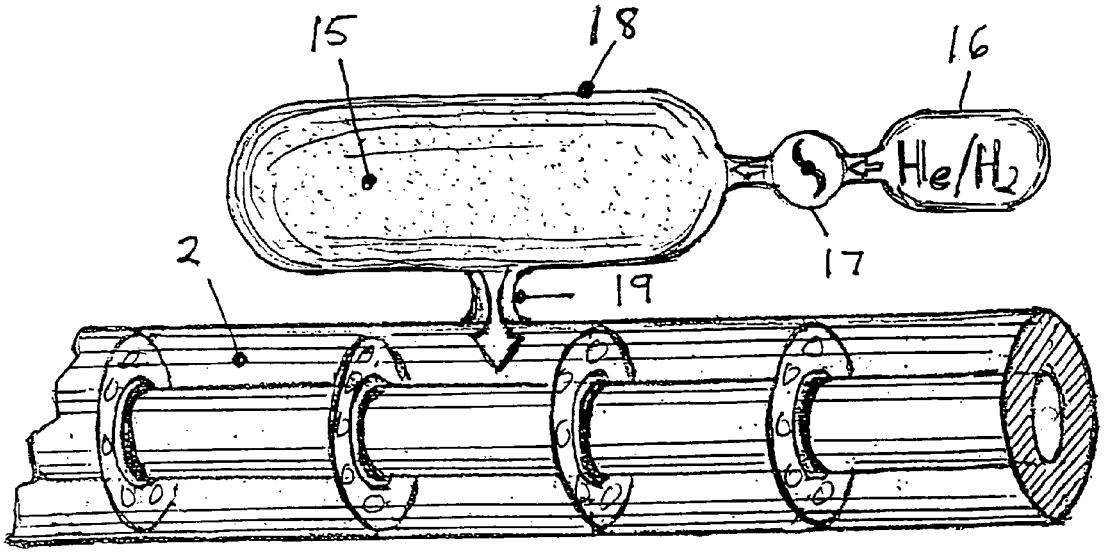

FIG. 3*b* shows a variant where the helium or hydrogen 16 is pumped into an external high pressure vessel 18 through a high pressure pump 17, then released into the AGC 2 just prior to launch (seconds or fraction of a second) via a high pressure valve 19 or frangible disk. The rationale for having a variant with an external tank is as follows. If there are pin-hole leaks in the AGC which has numerous high pressure valves, it may be difficult to maintain an extreme high pressure in the AGC during a lengthy pumping process (shown in FIG. 3*a*) since there are multiple valves in the AGC that must maintain the extreme high pressure during this time. By pumping up a separate external high-pressure vessel 18, which has only one orifice 19 and therefore can be sealed against the extremely high pressure, the problem may be solved. By venting the high-pressure gas 15 into the AGC just prior to launch (1-2 second), the effects of the pin-hole leaks will be minimized.

Figure 3C:
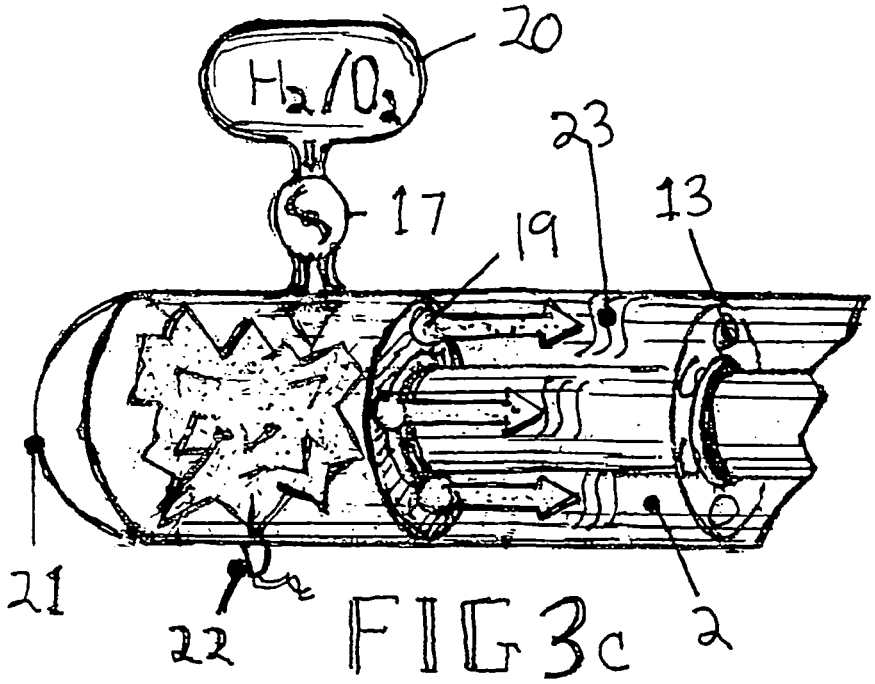
Figure 3D:
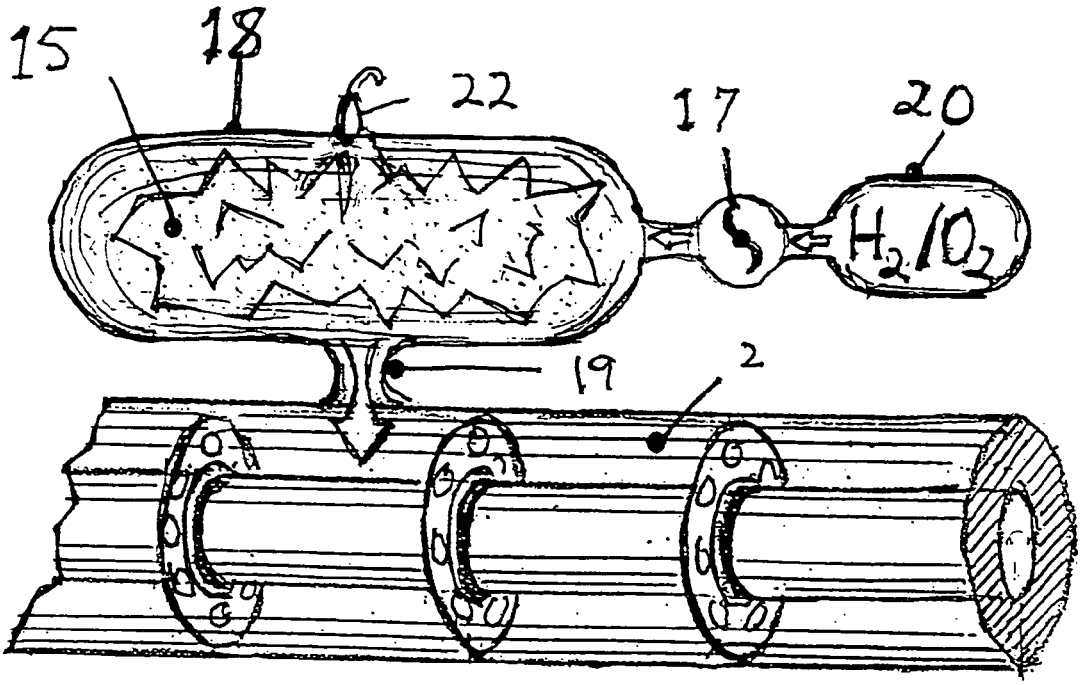
Figure 3E:
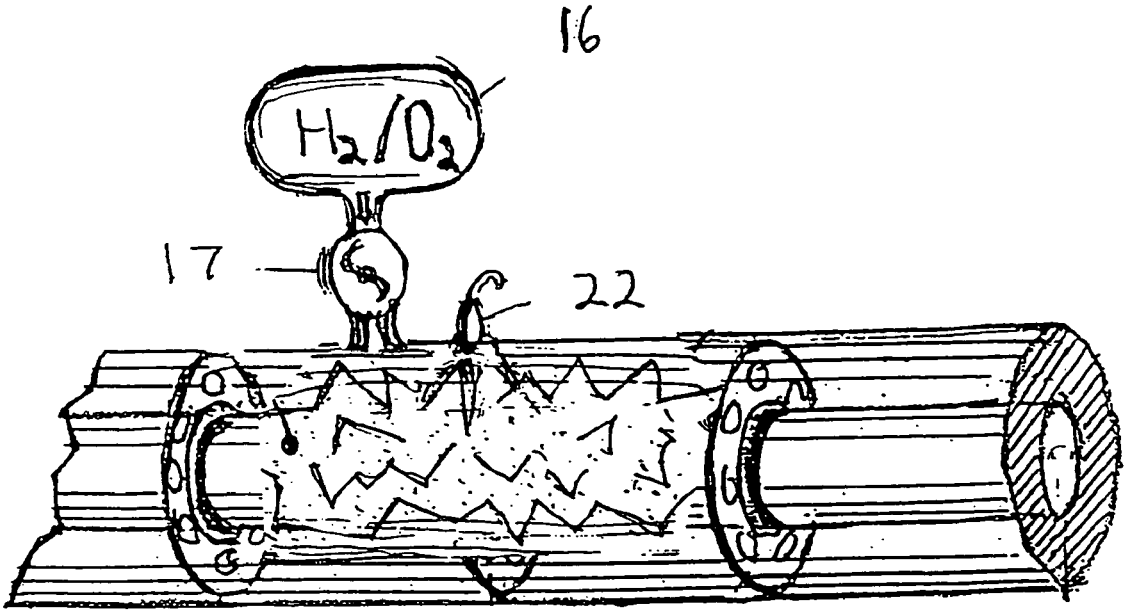

FIGS. 3*c*, 3*d*, and 3*e* show variants where the high-pressure gas is generated through the combustion of hydrogen and oxygen which can be stored cryogenically near the MHL site. Other high energy density combustible gases may also be used. In FIG. 3*c*, a mixture of H2 and O2 20 is pumped into an aft pressure vessel 21 by means of an external pump 17, and subsequently ignited with igniter 22. A wave front of high-pressure gas 23 enters the AGC 2 and propagates through openings 13 in the bulkheads, arriving at the muzzle end of the AGC, before the projectile exits the muzzle. It is assumed here that the projectile, having some mass will have a velocity less than that of the wave front propagating through the AGC.

FIG. 3*d* shows an external high pressure vessel 18, similar to that found in 3*b*, but with the high pressure gas generated by combustion of H2 and O2 20 pumped into the vessel with pump 17 and ignited by igniter 22, just prior to launch, (1-2 seconds). The high-pressure gas 15 is then injected into the AGC 2 via valve 19.

FIG. 3*e* shows the case where the H2/O2 mixture is pumped directly into the AGC 2 through pump 17, then ignited with igniter 22, creating high-pressure gas 15 which is then sequentially injected into the IBC through valves 9.

Figure 3F:
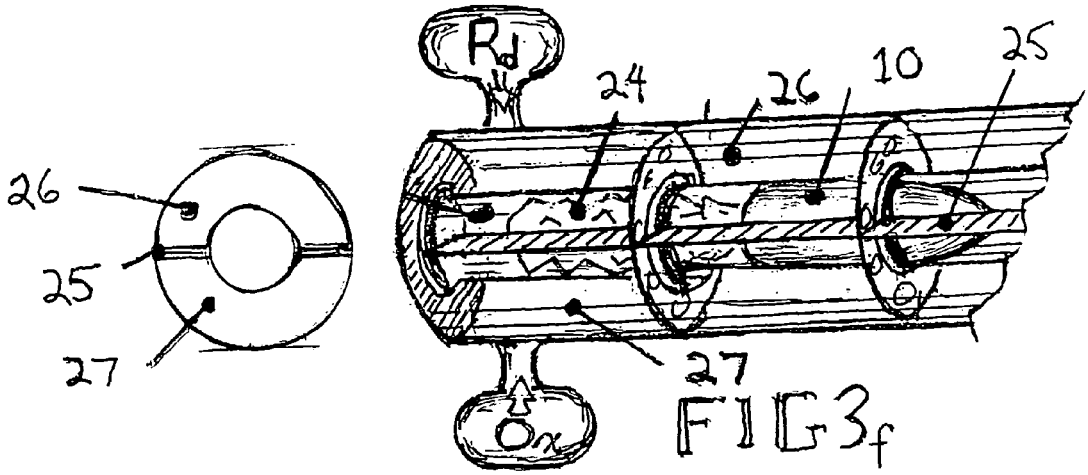
Figure 3G:
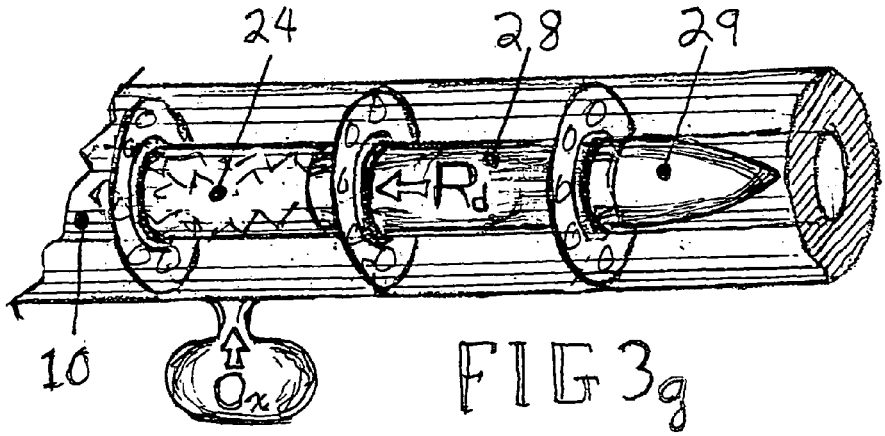

FIGS. 3*f* and 3*g* show variants where the pressure head behind the projectile 14 is created by a combustion front 24 generated in the IBC 10. In the case of FIG. 3*f*, the combustion front is created and sustained by the introduction of gaseous bipropellants into the IBC 10 from a split chamber AGC 2. The bipropellants could be H2 or O2, or other oxidizers $O_z$ or Reductants $R_d$ (fuels) in gaseous form. This would include hypergolic substances that combust spontaneously in the IBC when introduced from the split chamber AGC. The split chamber AGC shown in FIG. 3*f* is constructed as follows. A wall 25 runs the length of the AGC dividing it into an upper chamber 26 containing the reductant or fuel, and the lower chamber, as shown in the illustration, containing the oxidizer.

In FIG. 3*g*, the principle of combustion 24 in the IBC is the same, but only one of the reactants (either oxidizer or reductant) is contained in the AGC, while the other reactant is contained in the projectile itself, in a stage 28 behind the payload 29. The propellant in the projectile 28 could be in the form of a liquid or powder sprayed out from the aft end of the projectile and vaporized in the combustion front 24. In an alternate design, a fuel rich propellant can be partially burned in the projectile and ejected from the nozzle in order to react further with the oxidizer, entering the IBC behind the projectile.

Projectiles

FIGS. 4*a*-4*d* show various projectiles that could be "soft launched" by the MHL. Each has a rocket booster motor 30 that ignites after the projectile is launched from the MHL. Each has a payload 31 attached to a $1^{st}$ or $2^{nd}$ stage booster motor, and subsequently detached after the burn out of the booster motor. Each has an obdurator plate 32, a very robust disk that acts as a "pusher" plate, transferring the force of the high pressure gas to the projectile, and sealing the system so that the high pressure gas does not bypass the projectile. The obdurator plates are not rigidly attached to the projectiles, and they are discarded after launch by flying away from the projectile as it exits the muzzle. The obdurator plate made of polyethylene or other polymeric composite material can be recovered and reconditioned for subsequent launches.

Figures 4A, 4B, 4C, 4D:
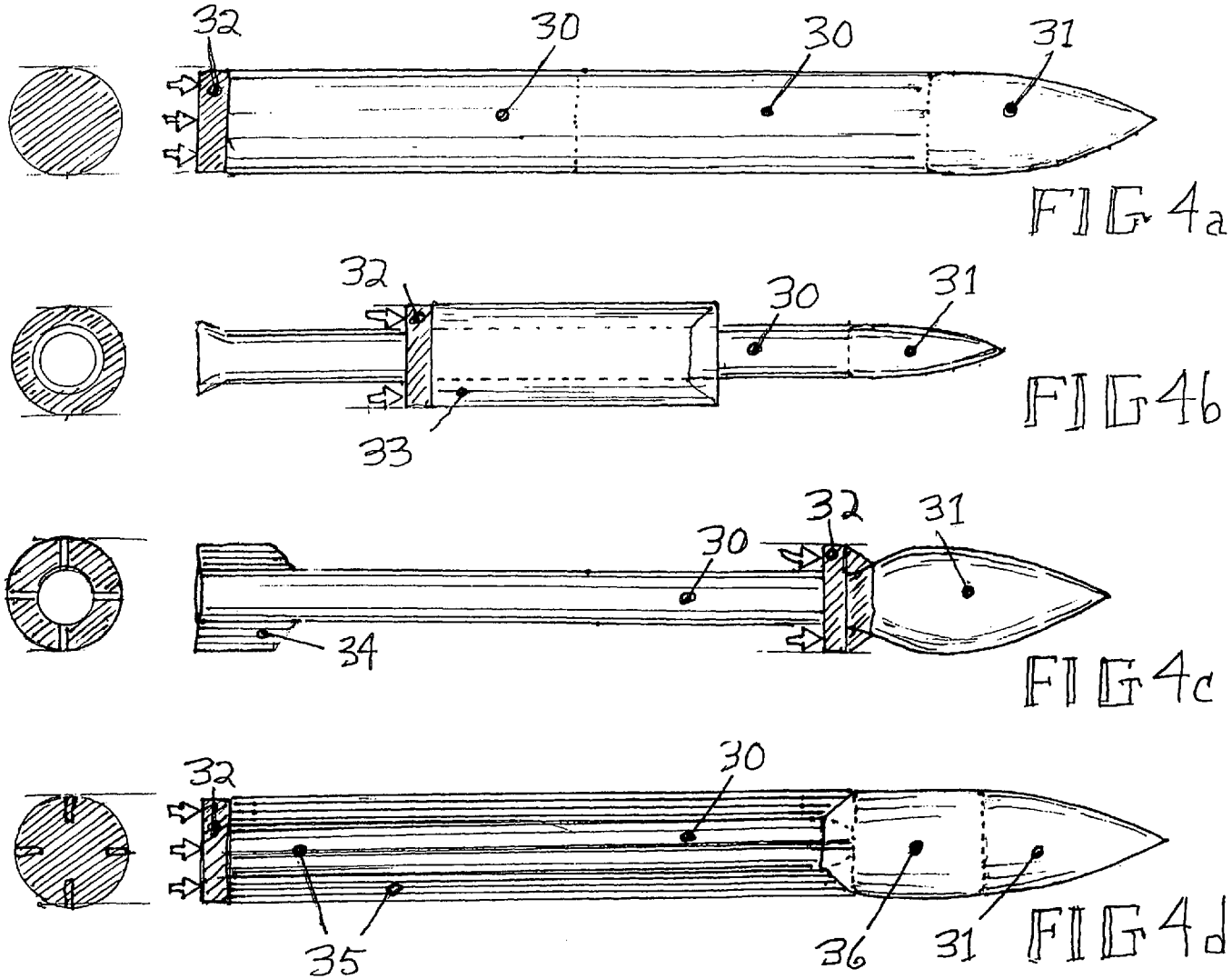
FIGS. 4*a-d* show different projectiles for launch.

Each of the figures illustrates a different projectile architecture. FIG. 4*a* shows a full bore two-stage rocket where the outside diameter of the rockets 30 are slightly less than the inside diameter of the barrel, with an obdurator plate 32 at the aft end of the projectile.

In FIG. 4*b*, the booster rocket motor is smaller in diameter than the barrel and requires a sabot 33 to stabilize the rocket during launch. The obdurator plate 32 is in the form of a ring structure behind the sabot, providing a seal similar to that afforded in FIG. 4*a*. Also shown is a small flared skirt around the aft end of the projectile to provide aerodynamic stability after launch. Both the sabot 33 and the obdurator ring 32 are segmented, so that they can fall away from the projectile as it leaves the muzzle, like any sabot projectile (e.g. High Energy Anti-Tank Rounds). Control of the booster after launch can be accomplished by trust vector control (TVC) nozzles, which are now common in commercial and defense rocket technology.

FIG. 4*c* shows also a smaller bore booster rocket motor with another means of lateral support in the barrel. In this case, there are aft fins 34 which provide aerodynamic stability after launch, but also stabilize the aft end of the projectile during launch, with the width of the fins slightly less than the inside diameter of the barrel. The obdurator ring 32 at the fore end, behind the payload 31 provides the seal to the barrel transferring the force of the high pressure gas to the fore end of the booster motor, pulling it along during launch (as opposed to the obdurator plates in FIGS. 4*a* and 4*d* that push the booster motors from the aft end). The obdurator ring 32 is also segmented and falls away from the projectile after launch.

In FIG. 4*d*, the smaller bore motor 30 has strakes 35 running the full length of the booster motor with obdurator plate 32 at the aft end in "pusher" mode. As with the fins in FIG. 4*c*, those strakes provide lateral stability during launch and aerodynamic stability after launch. In addition, the strakes provide a more robust structure for the booster motor in terms of post-launch aerodynamic stresses, especially bending or torsion moments on the smaller bore motor as it exits the muzzle. The strakes also spread the axial forces from the obdurator plate 30 along the whole body of the booster, and even into the fore-body structure, shown in the illustration as, a large diameter sustainer engine 36 and the payload 31.

The launch sequence of multi-stage rockets In FIGS. 4*a* and 4*d* is similar to that of conventional expendable launchers, with the MHL essentially providing the initial launch velocity of a typical large first stage in a multi-stage rocket. After the MHL launch, the aft stages of the MHL projectile, the boosters 30 and the sustainer 36 in FIG. 4*d*, are ignited sequentially and burn to increase the velocity, each steered by TVC nozzles or other means. After burn out and separation, the payload is 31 is put in low earth or other orbit around the earth.

At the heart of the MHL system is the design of the fast acting valves that can withstand the extreme pressures of the AGC 2, and yet open within milliseconds allowing the high-pressure gas in the AGC to flow into the barrel behind the projectile, each valve being triggered by the pressure head behind the projectile.

Fast Acting Valves

Two embodiments of the fast acting valves are described below: 1) a single port valve (SPV) mounted on the exterior of the inner barrel, within the AGC, that allows gas to flow from the AGC to the IBC though one orifice; 2) a multi-port valve (MPV) also mounted on the exterior of the inner barrel, and also within the AGC, that allows gas to flow from the AGC to the IBC through an annular ring of ports. Although the valves have significantly different geometries, they share common principals that allow them to operate successfully in the MHL.

1. The valves must withstand the extremely high-pressure differential between the AGC and the IBC, including shocks encountered in the AGC when gas is generated through combustion of fuel and oxidizer in the AGC (FIG. 3*e*).
2. The closing pressure on the valve is created by the extreme pressure differential between the AGC and IBC.
3. The valve is opened by the retraction of a sliding member containing the valve seat, here after referred to as the slider cup in the case of the SPV, and the slider ring in the case of the MPV. The slider retracts telescopically into a receiver structure, which is rigidly attached to the exterior wall of the inner barrel.

4. In order to achieve a very high-speed activation of the valve, the design is such that there is virtually no friction on the slider as it retracts into the receiver, with the motion of the slider orthogonal to the valve seat, and no contact other than metal to metal between the slider and the receiver.
5. The opening of the valve is activated when closing pressure on the slider is overcome by an opening pressure on the slider. This is created in the valve body, by high-pressure gas entering the valve body from the IBC. As the projectile in the IBC passes the valve port, high-pressure gas behind the projectile enters through a single port (SPV) or multiple ports (MPV) impinging on the interior of the slider, creating the opening force that ultimately exceeds the closing force, and triggers the opening of the valve,
6. After the projectile has passed the port, the pressure in the AGC equilibrates locally with that in IBC and there is no net force on the slider from gas pressure differential. The slider is then returned to the closed position by the moderate force of a spring, which is placed there for that purpose, and is compressed by the slider during the valve opening process.
7. All valves are able to recycle quickly to the closed position when the projectile exits the muzzle, allowing the immediate insertion of an new projectile through the breech, the restoration of high-pressure gas in the AGC (and vacuum in the IBC if desired), in preparation for a second shot.

Single Port Valve

Figure 5A:
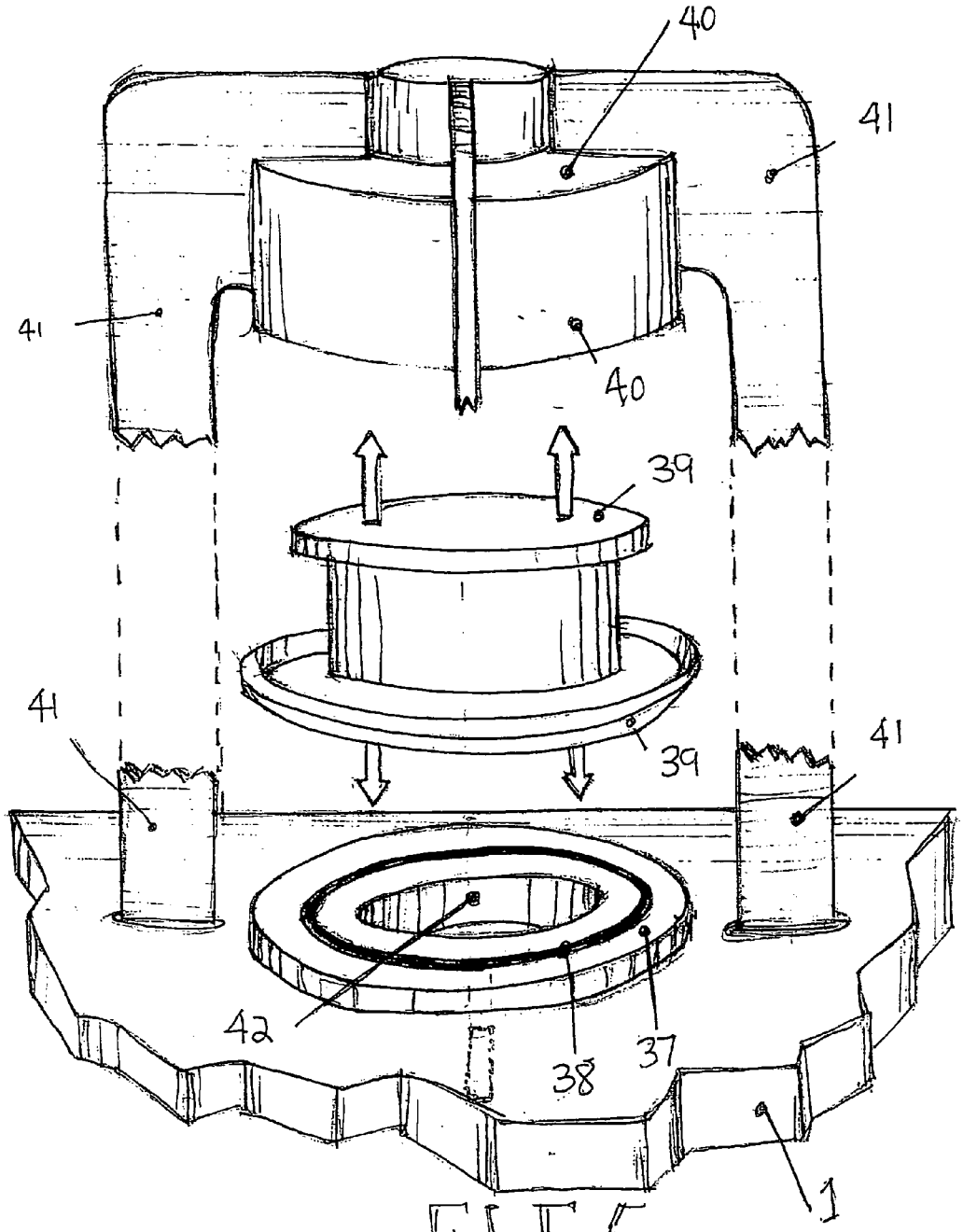
FIG. 5*a* is an exploded view of a single port valve for use on the launcher.

FIG. 5*a* shows and exploded view of the single port valve (SPV) attached to the exterior wall of the inner barrel, where the valve seat 37 contains an electrometric O-ring 38 that provides a high-pressure seal when the slider cup 39 is held against the valve seat 37 prior to valve activation. After activation, slider cup 39 is retracted telescopically into the receiver cup 40. The receiver cup is held rigidly to the inner barrel 1 by pedestal mounts 41 that are welded to the receiver and the inner barrel. When the valve activates, high-pressure gas from the AGC flows into the IBC through port 42.

Figure 5B:
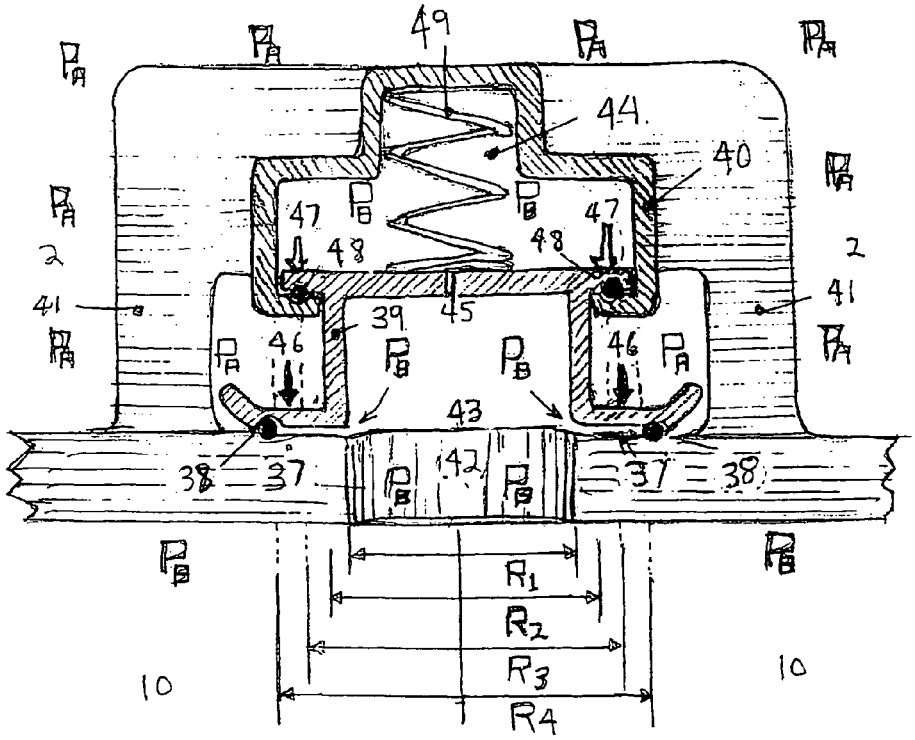
FIGS. 5*b-e* show sequences of sealing, opening and pressure flowing and increasing through the valve before and after the projectile passes the valve.

FIG. 5*b* is a cutaway side view of the SPV showing the valve in a closed position prior to launch. The slider cup 39 is fitting snugly against the valve seat 37 with the electrometric O-ring 38 providing a high-pressure seal. High-pressure gas in the AGC 2 shown as $P_A$ is blocked from flowing into the IBC 10 through port 42, where the pre-launch barrel pressure $P_B$ extends into the slider cup enclosed volume 43 through port 42, and then into the receiver enclosed volume 44 through pin hole opening 45.

Under pressure equilibrium conditions, the slider 39 is held shut by spring 49. The closing force on the valve, however, is determined primarily by the extreme differential pressure when $P_A$ is much greater than $P_B$, ($P_A >>> P_B$). The downward force on the slider 39 shown in the figure as black arrow 46, is equal to $P_A$ times the area of an annular ring 46 the outside radius of which is R4 and the inside radius R3 which is also the radius of an O-ring 48 shown above at 47 where the there is an interface between the slider cup 39 and the receiver cup 40.

The pressure on the outside radius of the O-ring 38 is $P_A$ while the pressure on the inside is $P_B$ since there is a gap between the slider 39 and the valve seat 37 on the exterior of the inner barrel 1. This gap has direct access to the interior of the valve core 43 and is therefore in equilibrium with the core pressure $P_B$. The downward pressure on the whole slider cup 39 is transferred mechanically to the interface between the slider cup 39 and the receiver cup 40 shown as seal 47 with O-ring 48. The force 46 on the valve seat O-ring 38 and the force 47 on the interface O-ring 48 are equivalent due to the fact that both are part of the slider cup structure 39 and are therefore mechanically linked. There is an additional force provided by the closer spring 49, but this force is only a fraction of that provided by the differential pressure of $P_A$ and $P_B$ acting on the slider cup at point 46.

Note there is also a force exerted downward on the slider cup 39 equivalent to $P_A$ times the area subtended by an annular ring formed by the inner radius of the valve seal O-ring 38 with radius R3 and the outer radius R2 of the slider cup cylindrical structure. This downward force however is counteracted by an equal and upward force on the slider cup 39 by $P_A$ times an annular ring of equal area bounded by the inner radius of O-ring 48 that is, R3, and the outer radius R2 of the slider cup cylindrical structure. Thus the total net downward force on the slider cup is 46, equal to $P_A$ times the annular area 46.

Figure 5C:
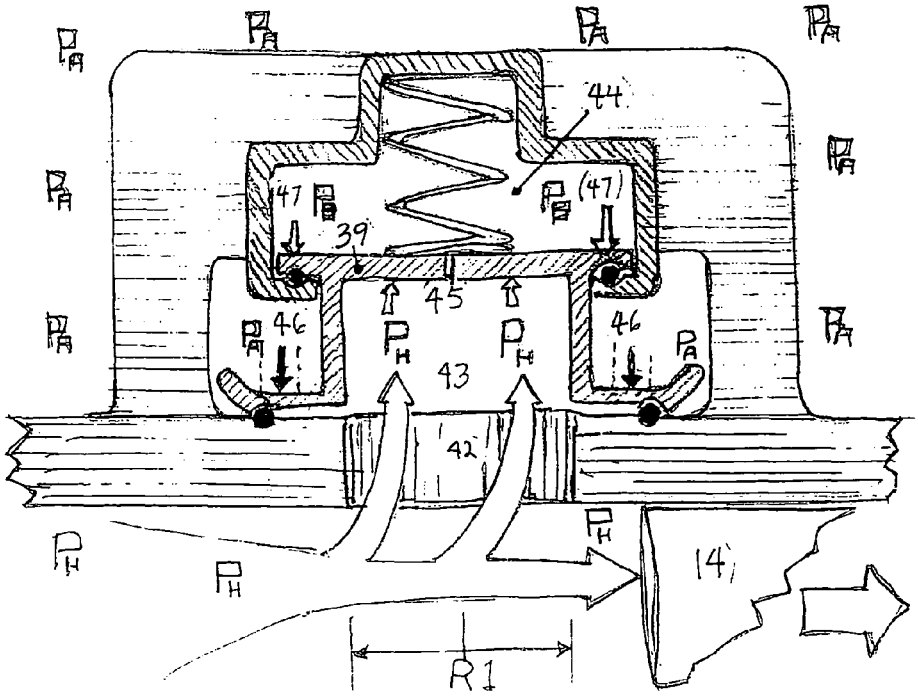

FIG. 5*c* shows the change in pressures due to the passage of the projectile 14 past the SPV port 42. The pressure outside of the port changes rapidly (milliseconds) from a vacuum or near-vacuum $P_B$ to the pressure head $P_H$ behind the projectile, which is approximately equal to the pressure $P_A$ in the AGC. The pressure change in the valve core 43 now exerts an extreme upward force on the slider cup 39 equivalent to $P_H$ times the area of the top of the slider cup, with radius R1. The downward force on the top of the cup provided by the pressure $P_B$ in the core of the receiver cup 44 is negligible (vacuum or near vacuum). The amount of hot gas leaking back into 44 from 43 through pin-hole 45 is negligible since the valve opening occurs in milliseconds, not enough time for substantial amounts of gas to pass from 43 into 44. The slider cup 39 will begin to move upward when the upward force on the slider cup, $(P_H \times \pi(R_1)^2)$ is equal to the downward force $(P_A \times (\pi(R_4)^2 - \pi(R_3)^2)$. For geometries illustrated in FIG. 5*b*, the area of the top of the slider cup is approximately 30% larger than the area of the annular seal. This means that when $P_H$ reaches approximately 0.66 $P_A$, then the cup will begin to move.

Figure 5D:
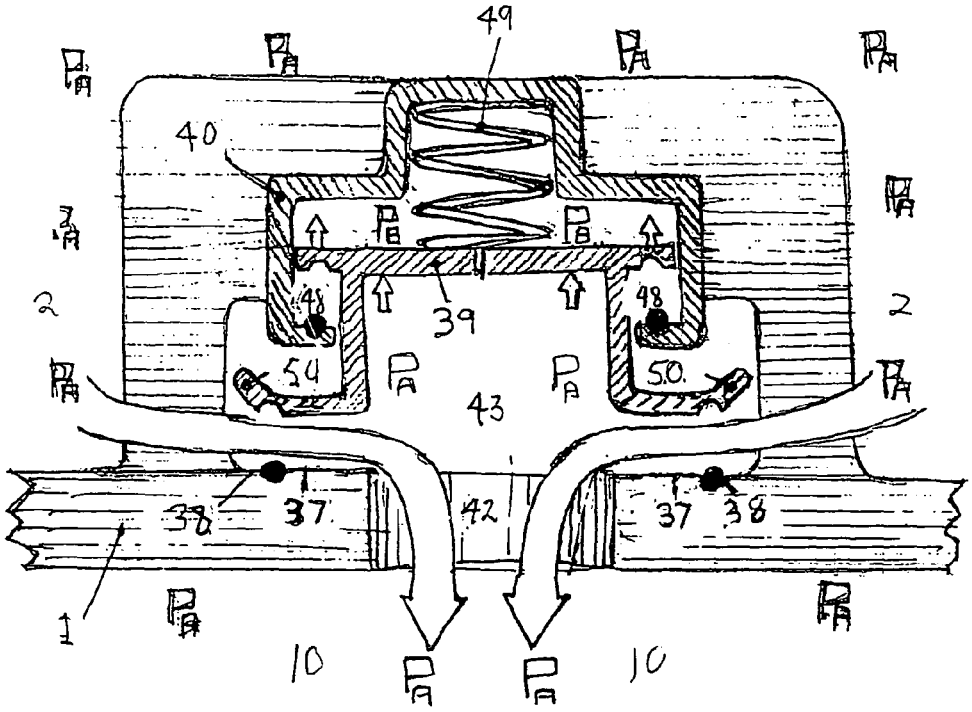

FIG. 5*d* shows the movement of the slider cup upward, with the valve seal O-ring 38 remaining affixed to the valve seat 37 on the inner barrel 1, and the interface O-ring 48 remains attached to receiver body 40. Spring 49 is shown undergoing compression while the slider cup 39 moves upward and admits high pressure gas from the AGC 2, into cavity 43 subsequently into the IBC 10 via port 42. The base of the slider cup has upward turning fluted edges 50 to aid the upward movement of the slider cup as high pressure gas impinges from the right and left sides of the slider cup, as shown in the illustration.

Figure 5E:
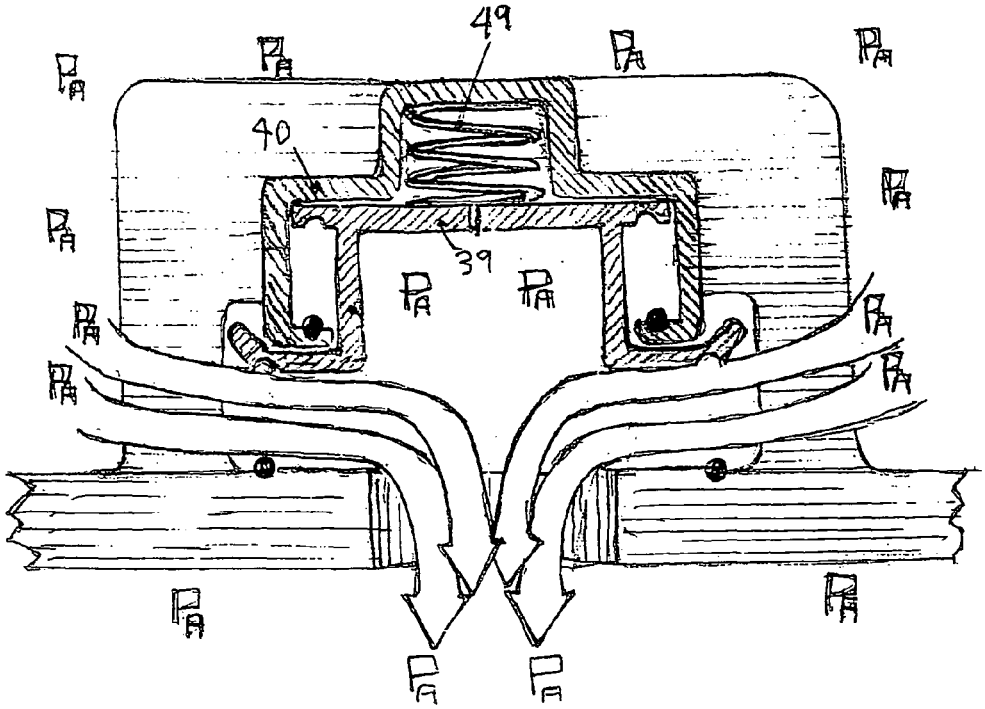

FIG. 5*e* shows the value in the full open position, with the top of the slider cup 39 reaching the base of the receiver cup 40, and the return spring 49 fully compressed. Once all of the gasses have reached pressure equilibrium in the AGC 2 and the IBC 10, there will be no net force opposing the closer spring 49 which will then return the slider ring to the original closed position as shown in FIG. 5*b*.

Multi-Port Valve

Figure 6A:
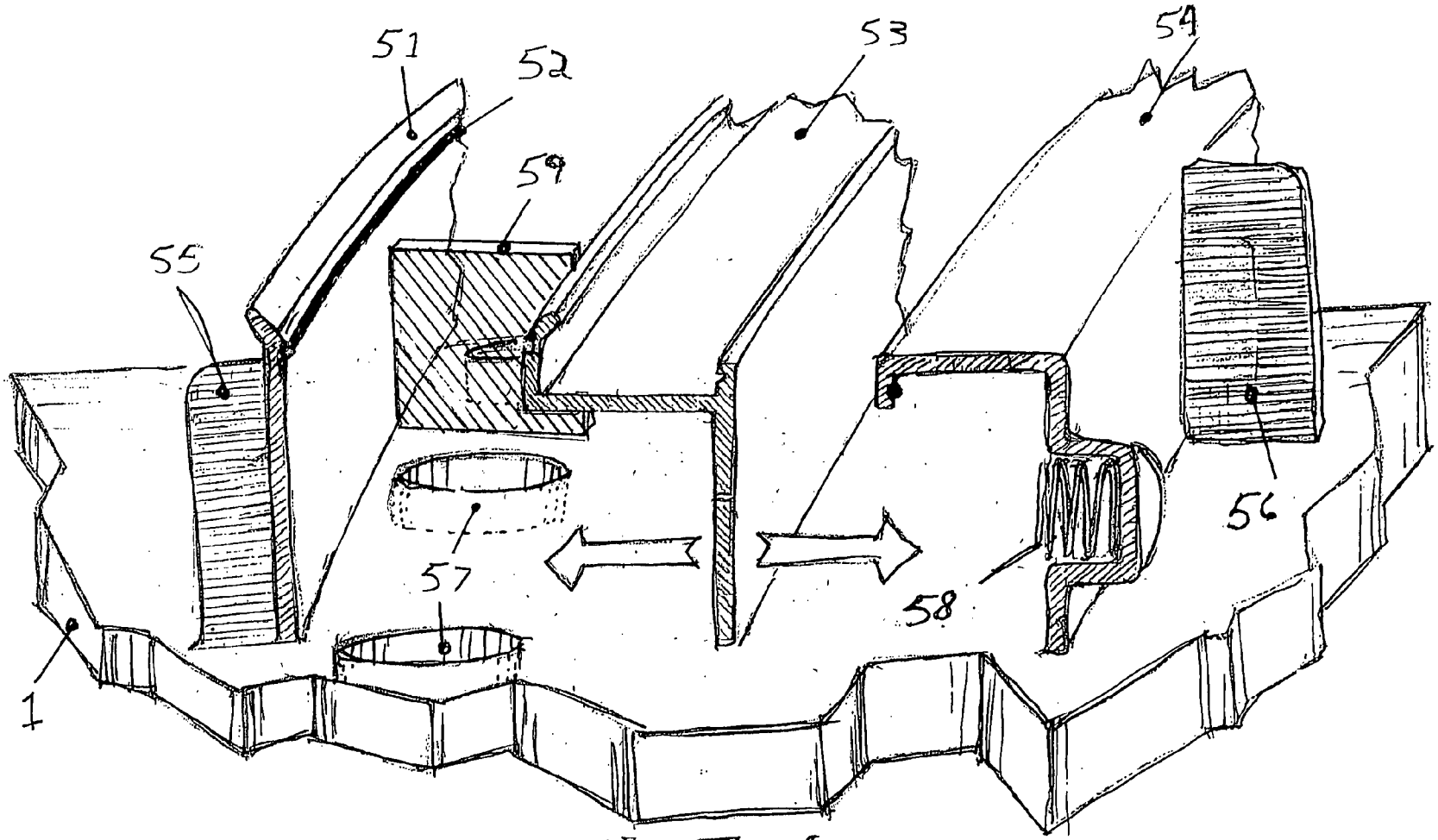
FIG. 6*a* is an exploded view of a multiple port valve.

FIG. 6*a* shows and exploded view of the Multi-Port Valve (MPV) attached to the exterior wall of the inner barrel, where the valve seat ring 51 contains an elastomeric valve seat O-ring 52 that provides a high-pressure seal when the slider ring 53 is held against the valve seat ring 51 prior to valve activation. After activation, slider ring 53 is retracted telescopically into the receiver ring 54.

Figure 6B:
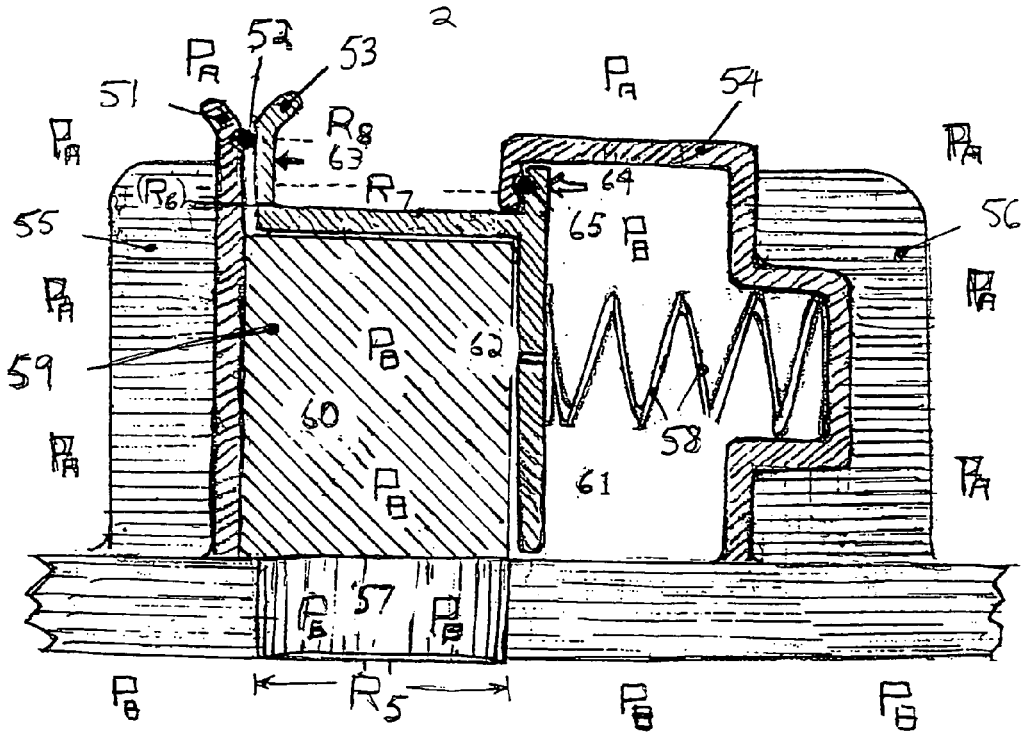
FIGS. 6*b-e* are cutaway views showing the multiple port valve in sequences of sealing, opening, introducing and increasing pressures as the projectile respectively approaches and passes the multiple port valve.

The valve seat ring 51 is supported by multiple stiffeners 55 welded to the exterior of the valve seat ring 51 and inner barrel 1. In like manner, the receiver ring 54 is supported by multiple stiffeners 56. When the valve activates, high-pressure gas from the AGC flows into the IBC through multiple ports 57 arranged around the circumference of the inner barrel 1. Guide plates 59 welded to the interior of the valve seat ring 51 and to the exterior of the inner barrel 1 between each of the ports 57 provides additional support to the valve seat ring, but also acts as a stiffener for the inner barrel structure adding to its structural integrity locally around the ports. FIG. 6*b* is a cutaway side view of the MPV showing the valve in a closed position prior to launch. The slider ring 53 is fitting snugly against the valve seat 51 with the valve seat elastrometric ring 52 providing a high-pressure seal. High-pressure gas in the AGC 2 shown as $P_A$, is blocked from flowing into the IBC 10 through ports 57, where the pre-launch barrel pressure $P_B$ extends into the slider ring enclosed volume 60 through port 57, and then into the receiver enclosed volume 61 through pin hole opening 62.

Under pressure equilibrium conditions, the slider ring 53 is held shut by springs 58 distributed around the receiver ring. In analogous fashion with respect to the SPV, the closing force on the MPV valve is determined primarily by the extreme differential pressure when $P_A$ is much greater than $P_B$ ($P_A >>> P_B$). The closing force on the slider ring 53 shown in the figure as black arrow 63, is equal to $P_A$ times the area of an annular ring 63 the outside radius of which is R8 and the inside radius R7 which is also the radius of an O-ring 65 where there is an interface between the slider ring 53 and receiver ring 54.

The pressure on the outside radius of the valve seal O-ring 52 is $P_A$ while the pressure on the inside is $P_B$ since there is a gap between the slider ring 54 and the valve seat 51 below ring 52. This gap has direct access to the interior of the valve core 60 and is therefore in equilibrium with the core pressure $P_B$. The closing pressure on the whole slider ring 53 is transferred mechanically to the interface between the slider ring 53 and the receiver cup 54 shown as seal 64 with O-ring 65. The force 63 on the valve seat O-ring 52 and the force 64 on the interface O-ring 65 are equivalent due to the fact that both are part of the slider ring structure 53 and are therefore mechanically linked. There is an additional force provided by the closer spring 49, but this force is only a fraction of that provided by the differential pressure of $P_A$ and $P_B$ acting on the slider ring at point 63.

The closing pressure on the whole slider ring 53 is transferred mechanically to the interface between the slider ring 53 and the receiver ring 54, which is shown as seal 64 with O-ring 65. The force 63 on the annular ring 52 and the force 64 on the O-ring 65 are equivalent due to the fact that both are part of the slider ring structure 53 and are therefore mechanically linked. There is an additional force provided by the closer spring 58, but this force is only a fraction of that provided by the differential pressure of $P_A$ and $P_B$ acting on the slider ring at point 63.

Note, analogous to the situation described for FIG. 5*b* there is also a closing force exerted on the slider ring 53 equivalent to $P_A$ times the area subtended by an annular ring formed by the inner radius R7 of the annular seal 52 and the outer radius R6 of the slider ring cylindrical structure exposed to $P_A$ in the AGC. This closing force however is counteracted by an equal and opposite opening force on the slider ring 53 by $P_A$ times an annular ring of equal area bounded by the radius R7, and the outer radius R6 of the slider ring cylindrical structure. Thus, there is no net force on the slider ring from pressure on the two annular areas subtended by R7 and R6 on the slider ring 53. The total net closing force on the slider ring 53 is therefore equal only to pressure $P_A$ exerted over the annular area over 63.

Figure 6C:
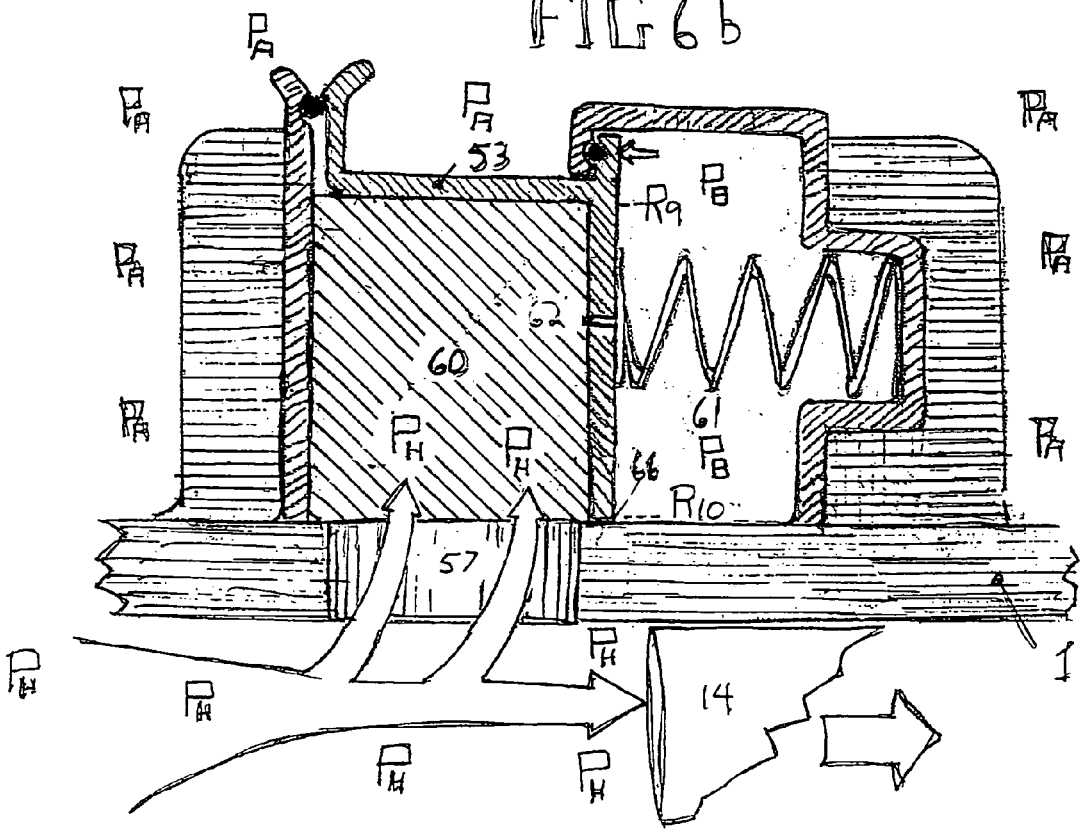

FIG. 6*c* shows the change in pressures due to the passage of the projectile 14 past the MPV ports 57. The pressure outside of the port changes rapidly (milliseconds) from a vacuum or near-vacuum $P_g$ to the pressure head $P_H$ behind the projectile, which is approximately equal to the pressure $P_A$ in the AGC. The pressure change in the valve core 60, with very little of the high pressure gas $P_H$ entering the receiver core 61 through pin hole 62 since the pin hole is small and the time of activation short. Likewise, these could be minor leakage at point 66 where the inner radius of the slider ring 53 meets the outer radius R10 of the barrel 1. As with the pin-hole, this leakage is small and the time of activation short, therefore there is minimal impact on the pressure mechanism for opening the valve. If, in practice, this leakage is deemed undesirable, an O-Ring arrangement similar to 65 could be implemented at point 66.

With the passage of the projectile 14, the pressure differential between the slider core 60 and the receiver core 61 is very large ($P_H >>> P_B$). This creates a large opening force on the slider ring 53 equivalent to $P_H$ times the area of the base of the slider ring, The area of the base of the slider ring is equivalent to the annular ring defined by R9 at its outer edge, and R10 at the inner edge. The slider ring 53 will begin to move from left to right in the figure when the opening force on the slider ring, $(P_H \times (\pi(R_9)^2 - \pi(R_{10})^2)$ is greater than the closing force which is created by pressure $P_A$ on annular ring area 63. For geometries illustrated in FIG. 6*b*, the total area of the slider ring base, defined above, under pressure from $P_H$ is much larger than that under the annular ring area 63, which is under pressure $P_A$. This means that the valve will begin to open when $P_H$ reaches some fraction of the pressure $P_A$ in the AGC.

Figure 6D:
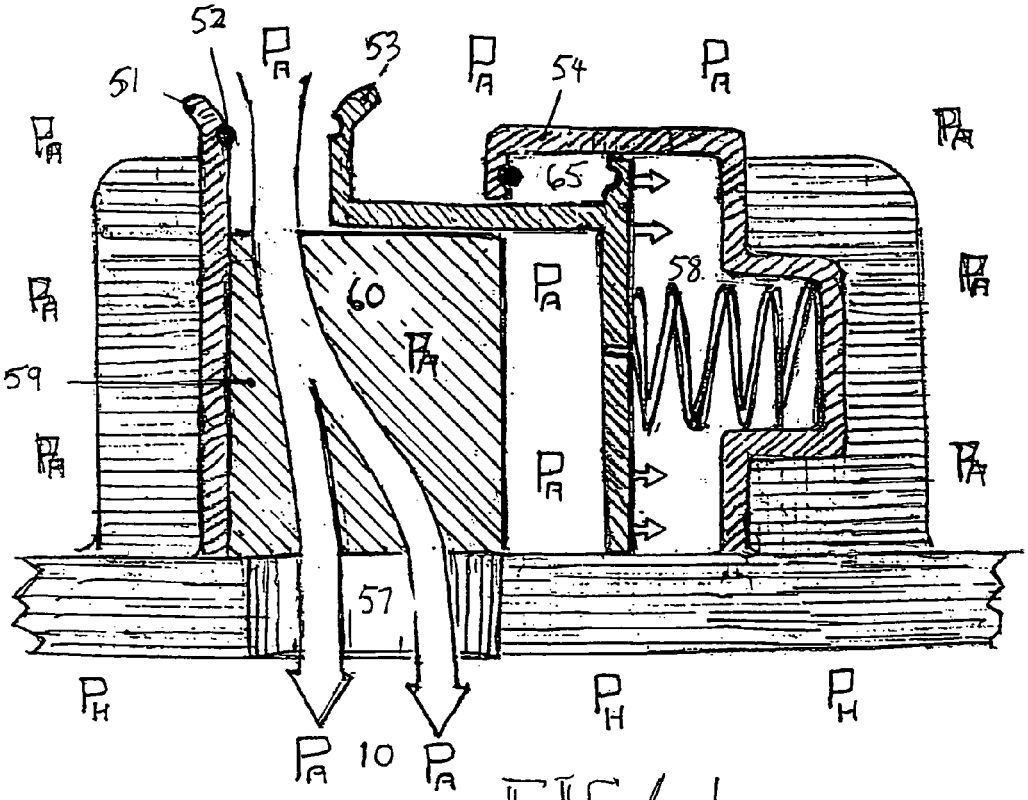

FIG. 6*d* shows the movement of the slider ring from left to right in the figure, with the valve seat O-ring 52 remaining affixed to the valve seat 51, and the O-ring 65 remaining attached to receiver ring body 54. Spring 58 is shown undergoing compression while the slider ring 54 moves toward the right and admits high pressure gas from the AGC 2, into cavity 60 subsequently into the IBC 10 via ports 57. The tops of the valve seat ring 51 and the slider ring 53 are fluted outward to aid the opening force on the slider ring as high pressure gas impinges from the top with a great deal of momentum, adding force to the opening of valve.

The guide plate 59 serves two purposes in the MHL. When the value is closed, the guide plates spaced evenly around the inner barrel provide support to the closefitting cylindrical part of the slider ring 53 which is under great pressure $P_A$ from the top, (see area marked 53 in FIG. 6*a*) and will presumably bend toward and rest firmly on the top of 59. When the high pressure gas $P_H$ enters the valve core 60 and equilibrates the downward pressure of $P_A$. It is anticipated that the cylindrical part of the slider ring 53 will bend upwards from the guide plate 59, allowing metal to metal contact only, and under little or no forces orthogonal to the seam, thus exerting little or no friction as the slider ring 53 moves to the right. The guide plates then serve the purpose of maintaining proper alignment of the slider ring so that its motion is orthogonal to the plane of the valve seat 51, and does not bind as it retracts into the receiver ring 54.

Figure 6E:
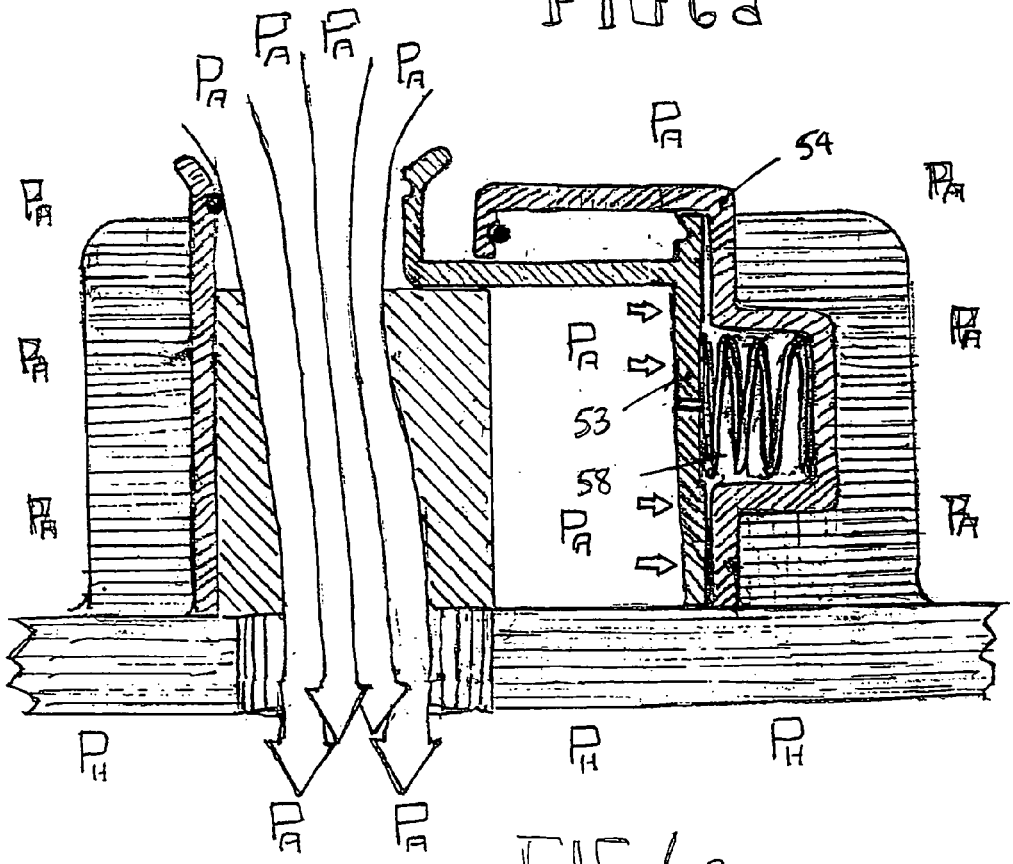

FIG. 6*e* shows the value in the full open position, with the base of the slider ring 53 reaching the base of the receiver ring 54, and the return spring 58 fully compressed. Once all of the gasses have reached pressure equilibrium in the AGC 2 and the IBC 10, there will be no net force opposing the closer spring 58 which will then return the slider ring to the original closed position as shown in FIG. 5*b*.

Figure 7A:
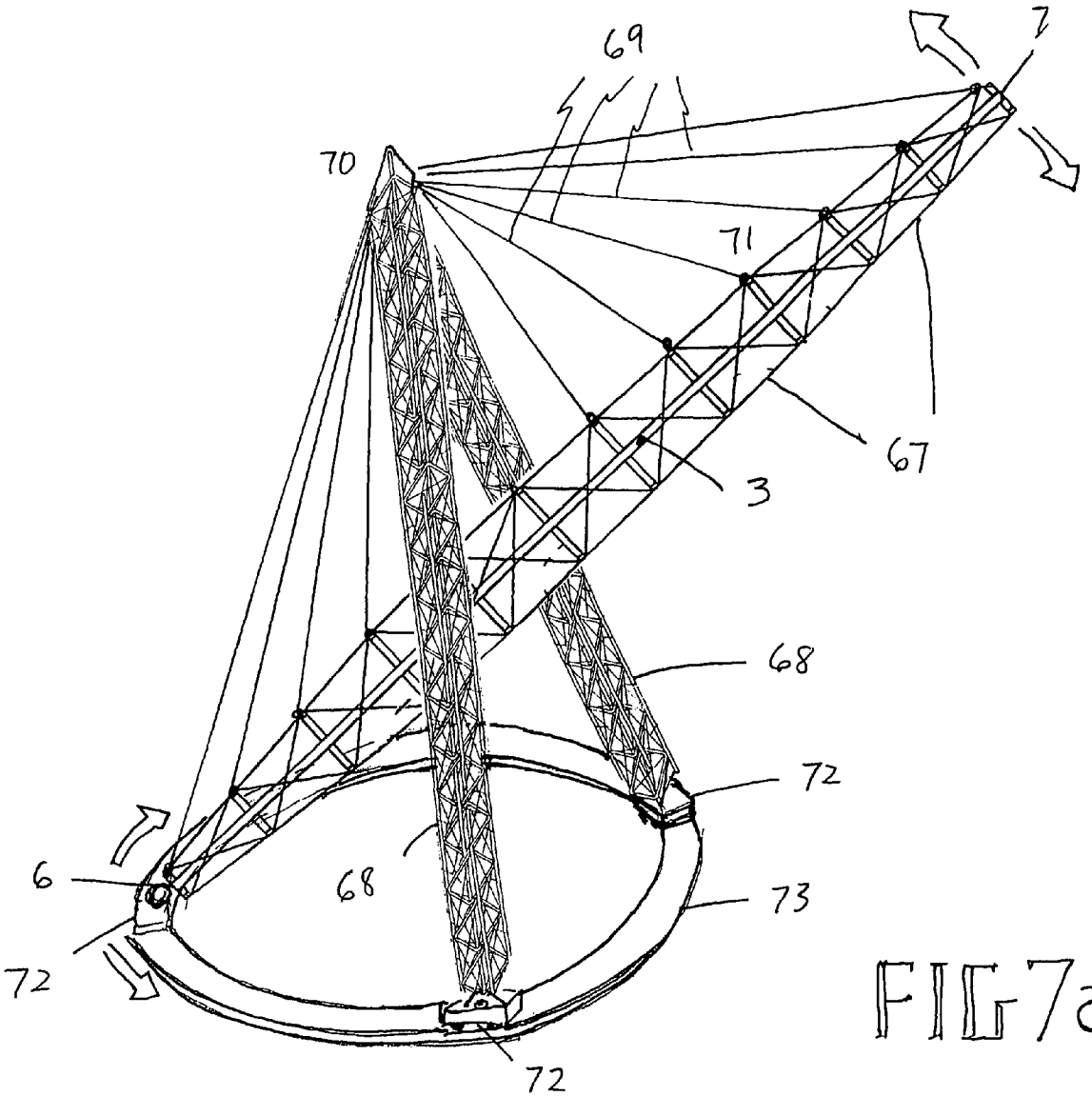
FIG. 7*a* shows a land-based launcher.

FIG. 7*a* shows a ground deployment of a large MHL where the outer casing 3 appears as a long tube (high length over diameter-L/D) in the center of a grid or network of cabling and cross members that provide a support structure 67 for the MHL tube, keeping it aligned in the axial direction. The MHL muzzle 7 appears in the upper right and the breech 6 in lower left. Two steel girder structures 68 provide support to the MHL from the top through multiple cables 69 running from the apex 70 to hard points 71 on the MHL support grid 67. The elevation of the MHL can be controlled by adjusting these cable lengths through pulleys and machinery at the apex 70. Motorized wheeled carts 72 at the base of the support girders 68 and at the breech 6 are capable of rotating the whole structure in the azimuth direction by movement along a circular track 73.

Figure 7B:
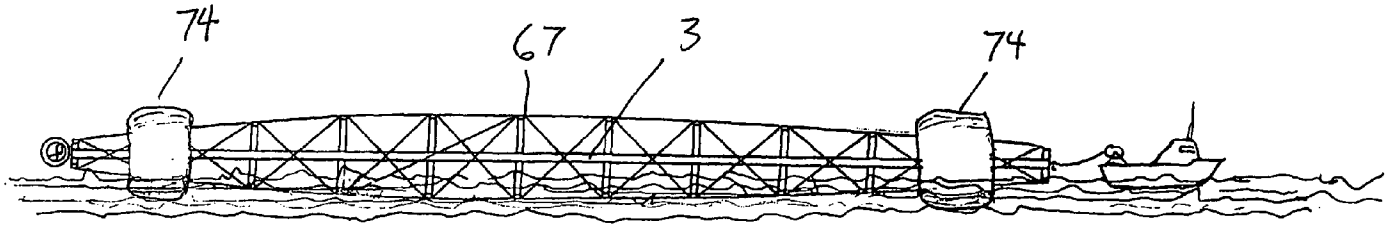
FIGS. 7*b* and *c* show towing and erecting a water-based launcher.
Figure 7C:
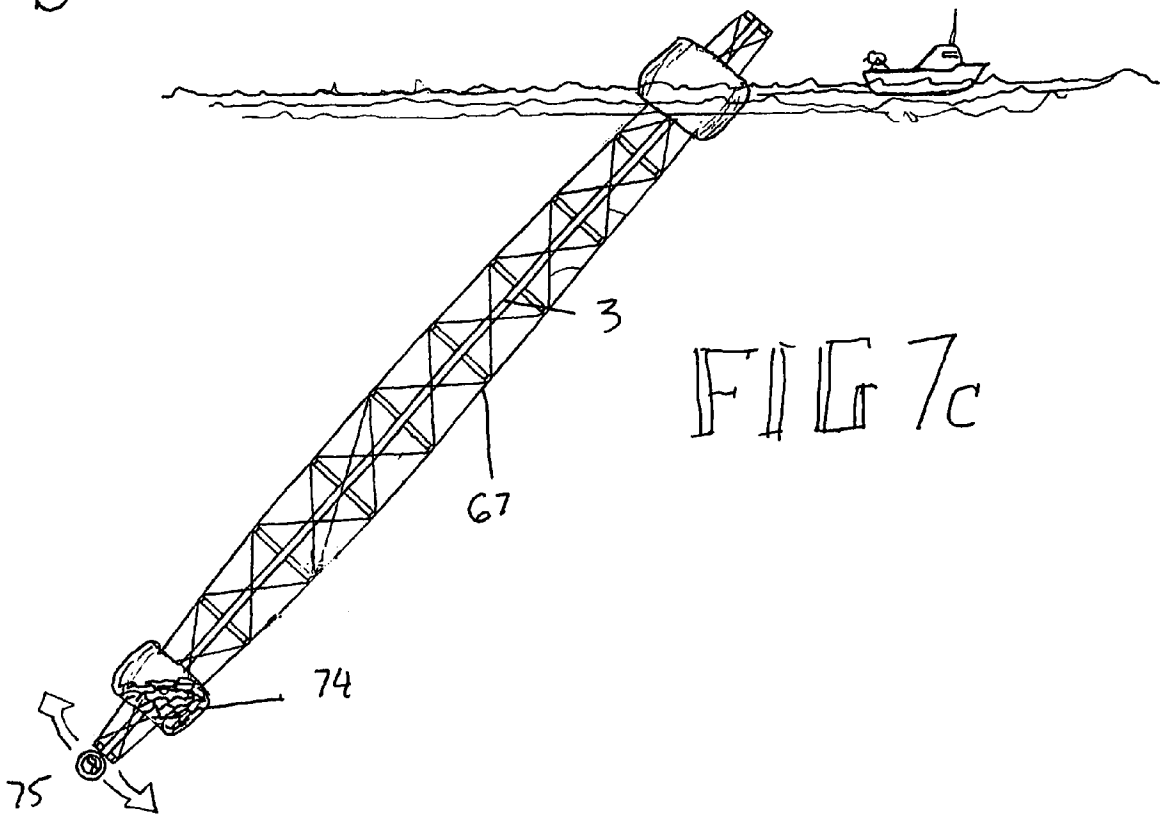

FIGS. 7*b* and 7*c* show a marine deployment of the MHL. In FIG. 7*b*, the MHL barrel shown as the outer casing 3 at the center of its support grid 67 being supported at each end by large floats 74 that allow it to be towed through the water to an off shore launch point. At the launch location, shown in FIG. 7*c*, the aft end float tank 74 is flooded, causing the MHL to rotate from the horizontal position, to a desired elevation prior to launch. Orientation in the azimuth direction can be accomplished with marine ducted thrust motors 75 at the breech end of the MHL.

Figure 8:
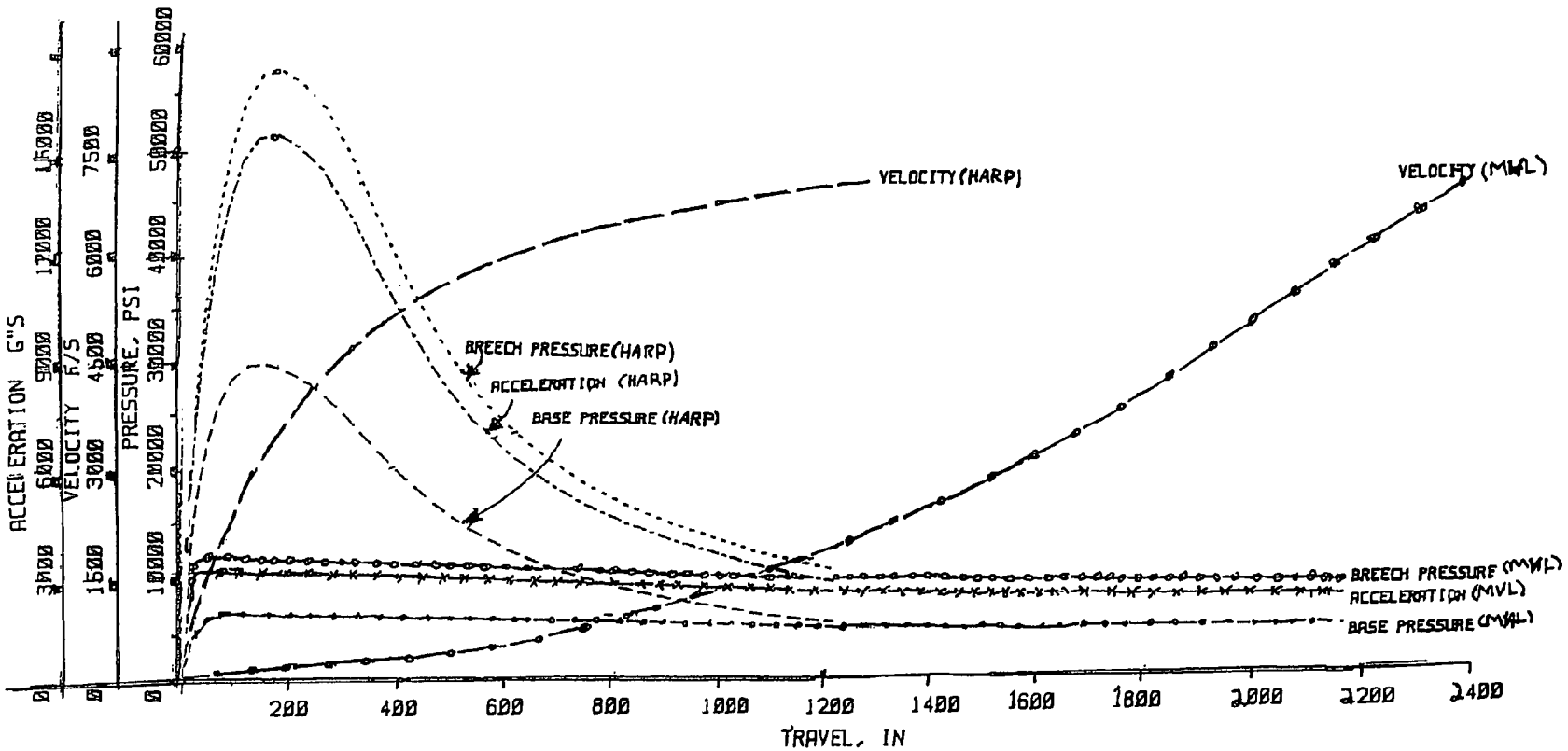
FIG. 8 compares pressures and projectile velocities in the new launcher with prior art pressures and velocities.

FIG. 8 illustrates why the MHL, as a launch system, differs fundamentally from that of a conventional large bore gun. The left hand side of the figure shows parameters of a 440 lb projectile being fired from the 16 inch HARP gun, cited in the first section "Description of Prior Art." The figure shows the expected large pulse in breech pressure during the initial stages of launch between 0 and 400 inches of barrel length. The acceleration of the projectile driven by the base pressure, also peaks early around 200 inches into the projectile flight. The rate of change in velocity is high initially, driven by the spike in base pressure, but gradually tapers off as the projectile passes down the barrel. The projectile reaches its terminal velocity at 1200 inches, which is the length of the gun.

The parameters of an MHL system are show at the bottom and right side of the figure, for a system that could launch a comparable sized, sabot projectile from an MHL barrel that is 200 foot long, with a 5 ft diameter to the outer casing. The figure shows MHL breech pressure, base pressure, and acceleration throughout the length of the barrel, as flat, modestly decreasing curves that are significantly lower than those of the HARP projectile over most of the HARP launch, and are only comparable to HARP parameters at the end HARP launch as the projectile exits the muzzle (1200 inches).

What is noteworthy is the ramp up in the velocity of the MHL projectile to a comparable level as that achieved by the HARP gun, but with relatively low pressures (max 12,000 psi for MHL versus a max 60,000 psi for the HARP gun). Even though the MHL launcher is longer, the overall weight could be considerably less than that of the HARP gun, because of the much lower pressure requirements.

The moderate decrease in the breech or base pressure for the MHL as the projectile moves down the barrel is due to the following. At the beginning of launch, the AGC is fully pressurized, and the IBC is in vacuum or at atmospheric pressure. As the projectile moves down the barrel, the valves open and high pressure gas from the AGC as it flows into the IBC is in effect "diluting" the high pressure gas from the AGC since it is now occupying a larger volume, that is the AGC volume plus the IBC volume. In a nominal architecture, the IBC volume is ¼ of that of the AGC, so there should be a 25% larger volume in which the high-pressure gas resides at the end of launch. This results in a 25% lower pressure in the AGC after equilibrium has been reached when the projectile exits the barrel. This translates to a constant reduction in the MHL projectile base pressure over the length of the barrel to 75% of the original base pressure at the beginning of launch.

While the invention has been described with reference to specific embodiments, modification and variations of the invention may be constructed without departing from the scope of the invention, which is defined in the following claims.

I claim:

1. Projectile launcher barrel apparatus comprising:

an inner barrel having an inner barrel chamber having proximal and distal ends;

a projectile in the inner barrel chamber;

an outer casing surrounding the inner barrel;

an axial gas chamber surrounding the inner barrel between the inner barrel and the outer casing;

plural spaced pressure-activated valves connected between the axial gas chamber and the inner barrel chamber, the valves sequentially opening from pressure behind the projectile and admitting pressurized gas from the axial gas chamber to the inner barrel chamber and accelerating the projectile through the inner barrel toward the distal end, wherein the pressure-activated valves have sealing seats and sliders on the seats, wherein the sliders have relatively large lifting areas and relatively small opposite retainer areas, wherein as the projectile passes the valves pressure within the inner cylinder chamber produces greater forces on the large areas, and pressure within the axial gas chamber produces lesser forces on the small retainer areas, and wherein force differential between the greater forces and the smaller forces move the sliders away from the seats, releasing pressure from the axial gas chamber to the inner barrel chamber behind the projectile.

2. The apparatus of claim 1, further comprising bulkheads extending radially outward from the proximal and distal ends of the inner barrel to the outer casing.

3. The apparatus of claim 1, further comprising diagonal stiffening connectors welded between the inner barrel and the outer casing stiffening the inner barrel.

4. The apparatus of claim 3, further comprising supports radially extending between the inner barrel and the outer casing at longitudinally spaced intervals along the inner barrel and outer casing.

5. The apparatus of claim 1, further comprising valves positioned on the inner barrel and spaced away from the proximal end and admitting pressurized gas from the axial gas chamber to the inner barrel chamber behind the projectile as the projectile passes the valves.

6. The apparatus of claim 1, a pump connected to the axial gas chamber and further comprising a source of pressurized gas connected to the pump supplying the axial gas chamber with gas at increased pressure.

7. The apparatus of claim 1, further comprising a pressurized gas storage chamber and a storage chamber valve between the pressurized gas storage chamber and the axial gas chamber for storing pressurized gas in the pressurized gas storage chamber and supplying the pressurized gas from the pressurized gas storage chamber to the axial gas chamber.

8. The apparatus of claim 1, further comprising an igniter in the inner barrel chamber near the proximal end for igniting, combusting, increasing pressure and expanding gas in the inner barrel chamber and driving the projectile through the inner barrel chamber toward the distal end, and an opening between the inner barrel chamber and axial gas chamber near the proximal end for concurrently increasing pressure in the axial gas chamber near the proximal end and creating a pressure wave front moving through the axial gas chamber from the proximal end to the distal end.

9. The apparatus of claim 1, further comprising dividers extending axially through the axial gas chamber between the inner barrel and the outer casing, dividing the axial gas chamber into first and second sides, and an oxidant gas inlet connected to the casing on the first side of the axial gas chamber, and a reactant gas inlet connected to the casing on the second side of the axial gas chamber for separately flowing oxidant, and reactant gases onto the casing and into the inner barrel chamber for oxidizing, combusting, expanding and pressurizing gas in the inner barrel chamber and driving the projectile toward the distal end.

10. The apparatus of claim 1, further comprising a source of oxidant gas connected to the axial gas chamber, and a reactant source connected to the projectile for oxidizing, combusting, generating, expanding and pressurizing gas in the inner barrel chamber and driving the projectile toward the distal end.

11. The apparatus of claim 1, wherein the projectile comprises a payload, a rocket motor, and an obdurator on the rocket motor for driving the obdurator with the pressurized gas in the inner barrel chamber and driving the rocket motor and the payload through the inner barrel chamber.

12. The apparatus of claim 1, further comprising closed volumes and compression springs opposite the larger areas of the sliders, extensions and seals opposite the larger areas of the sliders isolating the closed volumes when the extensions engage the seals and the sliders engage the seals, and moving the extensions away from the seals for communicating pressure in the axial gas chamber to the closed volumes when the sliders move away from the seats, thereby equalizing pressure and forces on opposite sides of the sliders with pressure from within the axial gas chamber, and allowing the springs to close the valves after they have been opened.

13. The apparatus of claim 12, wherein the valves have single ports and are arranged radially, the seats surround the single ports, and the sliders are hat-shaped and have rims engaging the seats and inner volumes with outer walls and tops for receiving pressures from within the inner barrel chamber, wherein the extensions extend outward from the tops, and wherein the closed volumes have walls and outer ends for engaging the springs, and the walls have inward extending lips for holding the seals against the extensions.

14. The apparatus of claim 12, wherein the valves have multiple ports and are arranged annularly around the inner barrel, wherein the sliders are annular and dish-shaped and have axially extending cylindrical walls with first and second ends, with radial rims extending from the first ends of the axially extending cylindrical walls forming the small areas, and wherein the sliders have radially extending annular tops at the second ends of the walls as the large areas for receiving the pressure from within the inner barrel chamber, and wherein the extensions are annular extensions extending radially from the second ends of radially extending cylindrical walls, wherein the closed volumes are annular chambers formed with axial walls, and annular tops against which the springs bear and inward extending annular radial lips opposite the tops, holding the seals against the annular extensions until the annular dish-shaped sliders are moved by pressure from the inner barrel chamber when the projectile passes the valves.

15. The apparatus of claim 12, further comprising closed volumes and compression springs opposite the relatively large areas of the sliders, extensions and seals opposite the relatively large areas of the sliders isolating the closed volumes when the extensions engage the seals and the sliders engage the seals, and moving the extensions away from the seals for communicating pressure from the high pressure chamber to the closed volumes when the sliders move away from the seats, thereby equalizing pressure and forces on opposite sides of the sliders with the pressure from the high pressure gas chamber, and allowing the compression springs to close the valves after the valves have been opened.

16. The apparatus of claim 12, wherein the valves are arranged radially on the barrel, the seats surround single ports in the barrel, and the sliders are hat-shaped and have rims engaging the seats and have inner volumes with tops for receiving pressures from within the barrel, wherein the extensions extend outward from the tops, and wherein the closed volumes have walls and outer ends for engaging the compression springs, and the walls have inward extending lips for holding the seals against the extensions.

17. The apparatus of claim 12, wherein the valves have multiple ports and are arranged annularly around the barrel, wherein the sliders are annular and dish-shaped and have axially extending cylindrical walls with radial rims extending from first ends of the walls forming the relatively small areas, and wherein the sliders have radially extending tops at opposite second ends of the walls forming the relatively large areas for receiving the pressure from within the barrel, and wherein the extensions are annular extensions extending radially from the walls, wherein the closed volumes are annular chambers formed with axial walls, annular radial tops against which the compression springs bear and inward extending annular radial lips holding the seals against the annular extensions until the annular dish-shaped sliders are moved by pressure from within the barrel.

18. The apparatus of claim 1, wherein multiple inner barrels and outer casings are joined end-to-end, forming an elongated projectile launcher barrel having breech and muzzle ends, and wherein the elongated projectile launcher barrel is supported by a minion on a proximal end and plural cables along the elongated projectile launcher barrel suspended from an A-frame truss.

19. The apparatus of claim 1, wherein multiple inner barrels and outer casings are joined end-to-end forming an elongated projectile launcher barrel, and wherein the elongated projectile launcher barrel is supported by flotation collars near breech and muzzle ends and is erected by flooding a flotation collar near the breech end and submerging the breech end.

20. Projectile launcher barrel apparatus comprising:

an inner barrel having an inner barrel chamber having proximal and distal ends;

a projectile in the inner barrel chamber;

an outer casing surrounding the inner barrel;

an axial gas chamber surrounding the inner barrel between the inner barrel and the outer casing;

plural spaced pressure-activated valves connected between the axial gas chamber and the inner barrel chamber, the valves sequentially opening from pressure behind the projectile and admitting pressurized gas from the axial gas chamber to the inner barrel chamber and accelerating the projectile through the inner barrel toward the distal end, further comprising internal supports extending between the inner barrel and the outer casing and having openings in the supports permitting pressure front travel along the axial gas chamber from near the bulkhead at the proximal end toward the bulkhead at the distal end.

21. Projectile launcher barrel apparatus comprising:

an inner barrel having an inner barrel chamber having proximal and distal ends;

a projectile in the inner barrel chamber;

an outer casing surrounding the inner barrel;

an axial gas chamber surrounding the inner barrel between the inner barrel and the outer casing;

plural spaced pressure-activated valves connected between the axial gas chamber and the inner barrel chamber, the valves sequentially opening from pressure behind the projectile and admitting pressurized gas from the axial gas chamber to the inner barrel chamber and accelerating the projectile through the inner barrel toward the distal end, a pressurized gas storage chamber and a storage chamber valve between the pressurized gas storage chamber and the axial gas chamber for storing pressurized gas in the pressurized gas storage chamber and supplying the pressurized gas from the pressurized gas storage chamber to the axial gas chamber, further comprising an igniter in the pressurized gas storage chamber for igniting and combusting gas in the pressurized gas storage chamber prior to supplying the pressurized gas from the pressurized gas storage chamber to the axial gas chamber.

22. The method of projectile launching comprising:

providing an inner barrel having breech and muzzle ends;

providing an inner barrel chamber in the inner barrel;

providing a projectile in the inner barrel chamber near the breech end of the inner barrel;

providing an outer casing surrounding the inner barrel;

providing an axial gas chamber between the inner barrel and the outer casing;

providing supporting interconnections between the inner barrel and the outer casing;

evacuating the inner barrel chamber near the muzzle end;

providing series of pressure-activated valves along the inner barrel;

driving the projectile from the breech end and toward the muzzle end;

providing pressurized gas in the axial gas chamber;

sequentially opening the valves with force differentials from pressure and area differentials of inner barrel chamber lower pressures applied to relatively large areas and axial gas chamber higher pressures applied to smaller areas;

flowing pressurized gas from the axial gas chamber through open valves into the inner barrel chamber behind the projectile as the projectile moves from the breech end to the muzzle end;

closing the valves with springs;

and accelerating the projectile from the breech end through the inner barrel chamber and outward through the muzzle end.

23. The method of claim 22, wherein the flowing further comprises flowing oxidizer gas and reactant gas separately through the valves, and reacting the oxidizer gas and the reactant gas in the inner barrel chamber.

24. The method of claim 22, further comprising providing a chemical reactant on the projectile and wherein the flowing comprises flowing pressurized oxidizer gas into the inner barrel chamber followed by reacting the oxidizer gas and the reactant in the inner barrel chamber behind the accelerating projectile.

25. Projector launcher barrel apparatus, comprising gas force opening valves which open with lower pressures within a barrel operating against higher resistant pressures in an axial high pressure gas chamber, wherein the valves have sealing seats on the barrel and sliders on the seats, wherein the sliders have relatively large areas and relatively small opposite retainer areas, wherein lesser pressures within the barrel produce greater forces on the relatively large areas, and greater pressures in the high pressure chamber produces lesser forces on the relatively small retainer areas, and wherein differential forces between the greater forces and the lesser forces move the sliders away from the seats, releasing greater pressure from the high pressure chamber through the valves to inside of the barrel.

* * * * *